US005811926A

United States Patent [19]

Novich

[11] Patent Number: 5,811,926

[45] Date of Patent: Sep. 22, 1998

[54] SPACER UNITS, IMAGE DISPLAY PANELS AND METHODS FOR MAKING AND USING THE SAME

[75] Inventor: Bruce E. Novich, Pittsburgh, Pa.

[73] Assignee: PPG Industries, Inc., Pittsburgh, Pa.

[21] Appl. No.: 665,713

[22] Filed: Jun. 18, 1996

[51] Int. Cl.[6] ..... H01J 01/62; H01J 63/04; H01J 01/88; H01J 19/42

[52] U.S. Cl. ..... 313/495; 313/243; 313/250; 313/258; 313/268; 313/288; 313/292; 313/497

[58] Field of Search ..... 313/238, 243–246, 313/249–250, 252, 254–258, 259–261, 268, 281, 284–286, 287–290, 292, 495–497

[56] References Cited

U.S. PATENT DOCUMENTS

| | | | |
|---|---|---|---|
| 3,611,019 | 10/1971 | Krembe | 313/201 |
| 3,755,704 | 8/1973 | Spindt et al. | 313/309 |
| 3,778,127 | 12/1973 | Langston, Jr. et al. | 316/20 |
| 3,803,439 | 4/1974 | Sasaki et al. | 313/188 |
| 3,808,497 | 4/1974 | Greeson, Jr. et al. | 313/182 |
| 3,829,734 | 8/1974 | Schofield | 313/217 |

(List continued on next page.)

FOREIGN PATENT DOCUMENTS

| | | |
|---|---|---|
| 2704672 | 11/1994 | France . |
| 739920 | 11/1955 | United Kingdom . |

OTHER PUBLICATIONS

Science of Ceramic Chemical Processing, John Wiley & Sons, 1986, p. 5.

Van Nostrand's Scientific Encyclopedia, Seventh Edition, Van Nostand Reinhold, 1989, pp. 529–533, 1521–1526, 1718, 1719, 1737.

Bulletin from Sem–Com Co., Inc., entitled "Flat Panel Display Components".

Hawley's Consensed Chemical Dictionary, Twelfth Edition, revised by Richard J. Lewis, Sr., Van Nostrand Reinhold Company, 1993, pp. 23, 325, 555, 565.

"Glass Substrates for flat Panel Displays", by Dawne M. Moffatt, MRS Bulletin, Mar. 1996, pp. 31–34.

"Diamond–Based Field–Emission Displays", by James E. Jaskie, MRS Bulletin, Mar. 1996, pp. 59–64.

*Encyclopedia of Polymer Science and Technology,* vol. 6, (1967) pp. 505–712.

K. Loewenstein, *The Manufacturing Technology of Glass Fibres* (3d Ed. 1993) pp. 25–27, 30–44, 47–60, 115–122, 126–135, 237–289, 165–172, 219–222.

*Hawley's Condensed Chemical Dictionary* (12th Ed. 1993) p. 331.

Cathey, *Information Display,* No. 10, pp. 16–20 (1995).

*Primary Examiner*—Sandra L. O'Shea
*Assistant Examiner*—Mack Haynes
*Attorney, Agent, or Firm*—Ann Marie Odorski

[57] ABSTRACT

The present invention provides image display panels, spacer units for the same and methods for making and using the same. The spacer units include an assembly having at least one layer of generally parallel fibers which form passageways which permit the passage of energy therethrough between the emitter and the display of an image display panel. A sealing frame has a support which is positioned about and engages the periphery or side of the spacer, the emitter and the display. The sealing frame has a sealing material for providing an essentially sealed region between the spacer, emitter and display. Methods of making and using such spacer units in image display panels are also included in the present invention.

25 Claims, 11 Drawing Sheets

U.S. PATENT DOCUMENTS

| | | | |
|---|---|---|---|
| 3,858,284 | 1/1975 | Costa et al. | 445/25 |
| 3,921,021 | 11/1975 | Glaser et al. | 313/188 |
| 4,091,305 | 5/1978 | Poley et al. | 313/220 |
| 4,099,082 | 7/1978 | Chodil et al. | 313/217 |
| 4,183,125 | 1/1980 | Meyer et al. | 29/25.15 |
| 4,227,114 | 10/1980 | De Jule | 313/217 |
| 4,341,980 | 7/1982 | Noguchi et al. | 315/169 |
| 4,390,647 | 6/1983 | Girgis | 523/212 |
| 4,422,731 | 12/1983 | Droguet et al. | 350/344 |
| 4,451,759 | 5/1984 | Heynisch | 313/495 |
| 4,795,678 | 1/1989 | Girgis | 428/391 |
| 4,857,799 | 8/1989 | Spindt et al. | 313/495 |
| 4,923,421 | 5/1990 | Brodie et al. | 445/24 |
| 4,940,916 | 7/1990 | Borel et al. | 313/306 |
| 5,032,761 | 7/1991 | Itoh et al. | 313/495 |
| 5,063,327 | 11/1991 | Brodie et al. | 313/482 |
| 5,083,058 | 1/1992 | Nonomura et al. | 313/497 X |
| 5,194,780 | 3/1993 | Meyer | 315/169.3 |
| 5,225,820 | 7/1993 | Clerc | 340/752 |
| 5,232,549 | 8/1993 | Cathey et al. | 456/633 |
| 5,329,207 | 7/1994 | Cathey et al. | 315/169.1 |
| 5,371,433 | 12/1994 | Horne et al. | 313/495 |
| 5,448,131 | 9/1995 | Taylor et al. | 313/309 |
| 5,449,970 | 9/1995 | Kumar et al. | 313/495 |
| 5,465,024 | 11/1995 | Kane | 313/309 |
| 5,469,021 | 11/1995 | Lepselter | 313/582 |
| 5,486,126 | 1/1996 | Cathey et al. | 445/25 |
| 5,489,558 | 2/1996 | Moffatt et al. | 501/69 |
| 5,491,376 | 2/1996 | Levine et al. | 313/495 |
| 5,498,925 | 3/1996 | Bell et al. | 313/497 |
| 5,547,483 | 8/1996 | Garcia et al. | 65/42 |
| 5,562,517 | 10/1996 | Taylor et al. | 445/25 |
| 5,578,899 | 11/1996 | Haven et al. | 313/495 X |

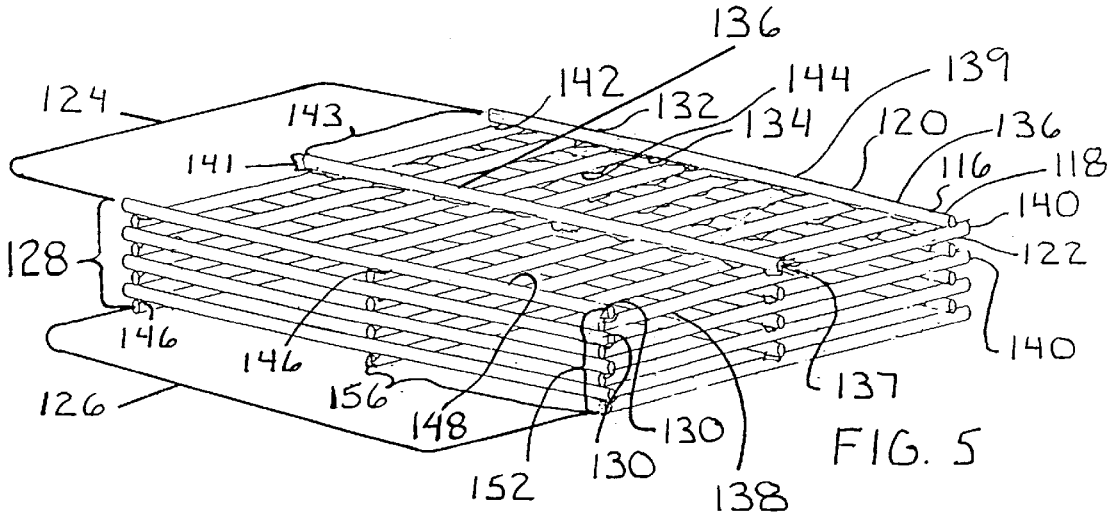
FIG. 5
FIG. 6
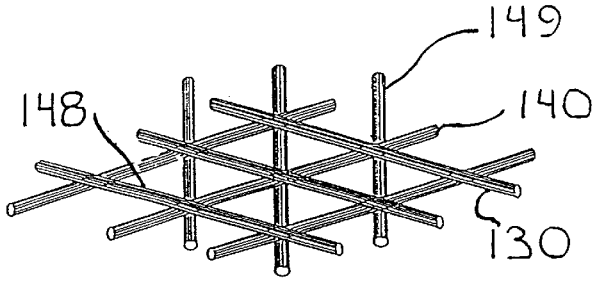
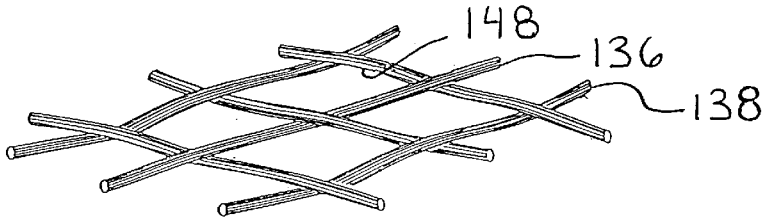
FIG. 7

SPACER UNITS, IMAGE DISPLAY PANELS AND METHODS FOR MAKING AND USING THE SAME

CROSS REFERENCE TO RELATED APPLICATION

This patent application is related to copending U.S. patent application Ser. No. 08/665,615 of Bruce E. Novich entitled "SPACERS, SPACER UNITS, IMAGE DISPLAY PANELS AND METHODS FOR MAKING AND USING THE SAME", filed concurrently with the present patent application.

FIELD OF THE INVENTION

The present invention relates generally to image display panels and, more particularly, to spacer units for aligning emitters and displays of image display panels, image display panels including the same, and methods for making and using the same.

BACKGROUND OF THE INVENTION

The demand for inexpensive, compact, lightweight and power efficient image display panels which provide color, contrast, brightness and resolution comparable to conventional cathode ray tube ("CRT") technology is increasing. Flat panel image display ("FPD") is desirable in applications such as portable computers and flat screen television, in which the significant physical depth of conventional CRT technology is a disadvantage.

Known flat panel image display devices include passive or active matrix liquid crystal displays ("LCD"), electroluminescent displays ("EL"), gas plasma displays and field emission displays ("FED"). The trend in FPD technology is to provide improved image resolution, faster data-to-image transfer, lighter weight, lower energy consumption and higher brightness. The combination of these trends has posed significant challenges for cost effective manufacture of flat panel displays.

Each of the various types of image displays described above typically include an emitter panel and opposed display panel. These panels must be insulated from each other to prevent an electrical breakdown. Uniform alignment and separation between the panels is necessary to provide low distortion, high brightness and uniform resolution. The problem of maintaining alignment and separation between the panels is exacerbated in image displays in which the interior of the display is maintained under vacuum, such as in field emission displays. A high aspect ratio spacer is needed to maintain accurate and precise separation between the emitter panel and the display panel without interfering with the transmission of energy such as electrons between the same, which can cause optical defects. As used herein, the term "aspect ratio" means the ratio of the spacer thickness to its width. A non-limiting example of a suitable aspect ratio for a spacer for use in a FPD is about 1000 micrometers ($\mu$m) to about 50 $\mu$m or about 20:1.

U.S. Pat. Nos. 4, 099,082 and 4,183,125 disclose cellular spacer-supports for a luminescent display panel. The spacer-support comprises a stack of mutually registered open lattices of tensioned, highly flexible insulative filaments (such as glass filaments) which define an array of narrow transverse openings to permit the unattenuated passage of energy therethrough (column 4, lines 59–63). The filaments are tensed into the desired configuration by stringing upon the pins of a frame (column 6, lines 3–7). The stack of filaments is coated with a cement such as glass cement (column 6, lines 33–36), potassium silicate, sodium silicate or glass cladding (col. 8, lines 13–16); cured in an oven (column 6, lines 59–62); and the edges of the spacer are trimmed (column 7, lines 20–22). However, it can be difficult to align the lattice openings of such a spacer with the corresponding pixel groups, maintain the lattice flat and parallel between the emitter and display panels to prevent fiber cracking during the FPD assembly process and to prevent cement from contaminating the interior components of the panel.

Misalignment of the spacer unit within the FPD can cause serious visual defects in the display and, in vacuum displays, can result in poor sealing leading to hermeticity failure. A high aspect ratio spacer unit is needed which is dimensionally stable, self-leveling, preferably free of cement materials which can contaminate interior components, resistant to thermal cycling, inexpensive to manufacture and install in an image display panel, easily modified for including additional components such as electrodes, and essentially self-aligning when installed between an emitter panel and a display panel. A spacer unit which is self-leveling and self-aligning is highly desirable to reduce cost and waste during FPD assembly.

SUMMARY OF THE INVENTION

The present invention provides a spacer unit, comprising: (a) a spacer for separating and aligning an emitter and a display of an image display panel, the spacer comprising an assembly having a first side, a second side and a third side extending between the first side and the second side, the assembly comprising at least one layer having a first side and a second side, the layer comprising a plurality of generally parallel, spaced apart fibers, the assembly having a plurality of passageways between the fibers of the layer, the passageways being generally perpendicular to the fibers of the layer, such that when the assembly is positioned between an emitter and a display of an image display panel at least one of the passageways permits the passage of energy therethrough between the emitter and the display; and (b) a sealing frame positioned about and engaging at least a portion of the third side of the spacer, the sealing frame having a first end adapted to be positioned adjacent to a portion of the emitter of the image display panel and a second end adapted to be positioned adjacent to a portion of the display of the image display panel, the sealing frame comprising: (1) a support positioned about and engaging at least a portion of the third side of the spacer and maintaining the fibers of the layer in generally parallel alignment, the support having a first end, a second end and a side therebetween; and (2) a sealing material positioned upon at least a portion of the first end or the second end of the support for bonding said portion of the support to a portion of an emitter and a portion of a display of an image display panel, such that when the sealing frame and spacer are positioned between the emitter and the display of the image display panel, the sealing frame provides an essentially sealed region therebetween.

Yet another aspect of the present invention is an image display panel comprising: (a) an emitter; (b) a display; and (c) the above spacer unit positioned therebetween.

Another aspect of the present invention is a method for making an image display panel, comprising the steps of: (a) positioning the above spacer unit between an emitter and a display of an image display panel; (b) heating the spacer unit under vacuum to deform at least a portion of the sealing material to bond the sealing frame between the emitter and display and form a substantially evacuated region therebetween.

Another aspect of the present invention is a method for making an image display panel, comprising the steps of: (a) positioning the above spacer unit between an emitter and a display of an image display panel; (b) heating the spacer unit to deform at least a portion of the sealing material to bond the sealing frame between the emitter and display and form an evacuatable region therebetween; and (c) at least partially evacuating the evacuatable region of the image display panel.

Another aspect of the present invention is a method for aligning an emitter substrate with a display, comprising the steps of: (a) positioning the above spacer unit between an emitter and a display; and (b) heating the spacer unit to deform at least a portion of the sealing material to bond the sealing frame between the emitter and display to align the emitter and display and form an evacuatable region therebetween.

BRIEF DESCRIPTION OF THE DRAWINGS

The foregoing summary, as well as the following detailed description of the preferred embodiments, will be better understood when read in conjunction with the appended drawings. In the drawings:

FIG. 5 is an enlarged perspective view of a portion of a spacer for use in a spacer unit according to the present invention;

FIG. 6 is an enlarged perspective view of a portion of an alternative embodiment of a spacer for use in a spacer unit according to the present invention;

FIG. 7 is an enlarged perspective view of a portion of another alternative embodiment of a spacer for use in a spacer unit according to the present invention;

DETAILED DESCRIPTION OF THE INVENTION

Figure 1:
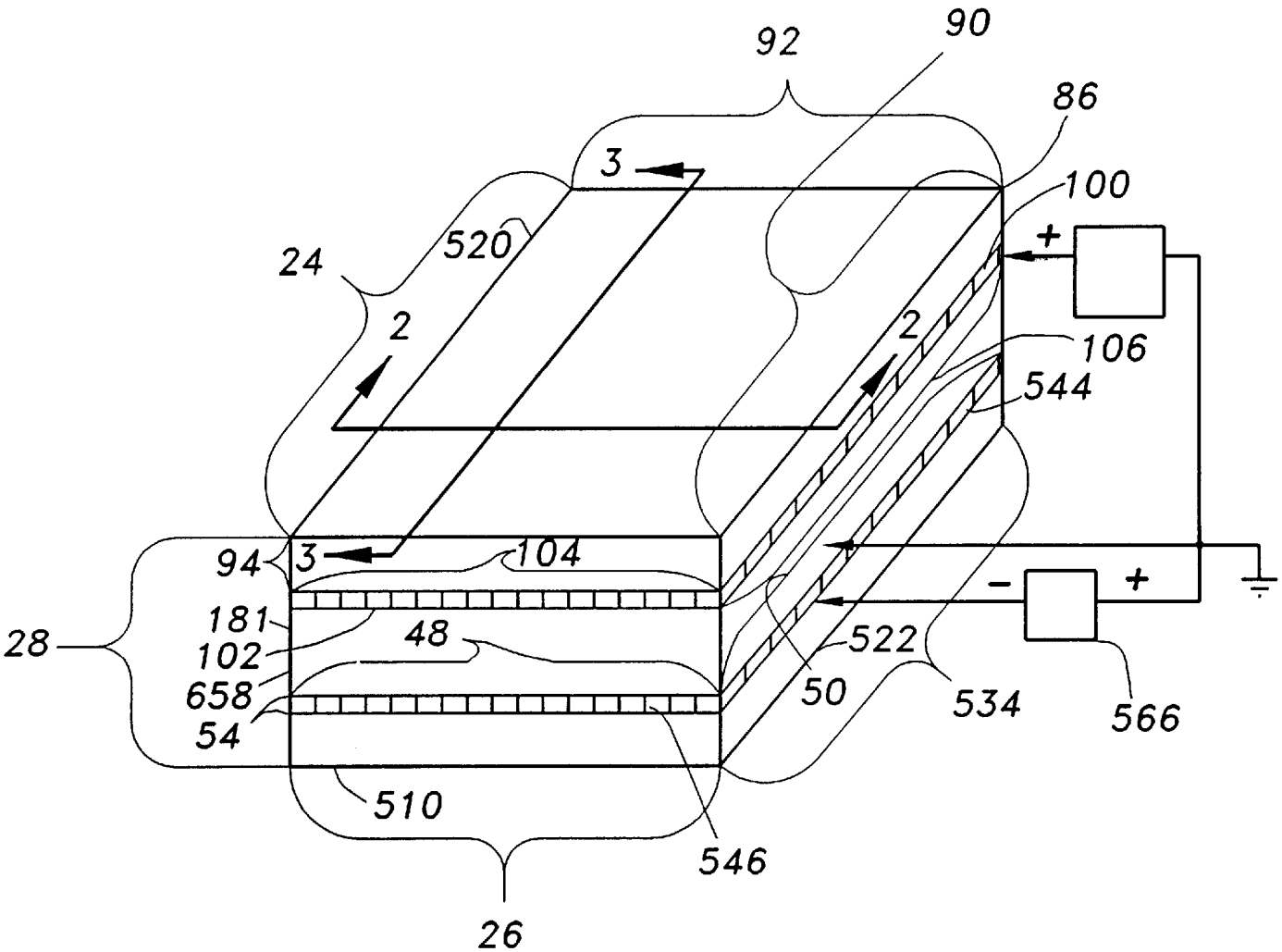
FIG. 1 is a schematic perspective view of an image display panel according to the present invention.
Figure 2:
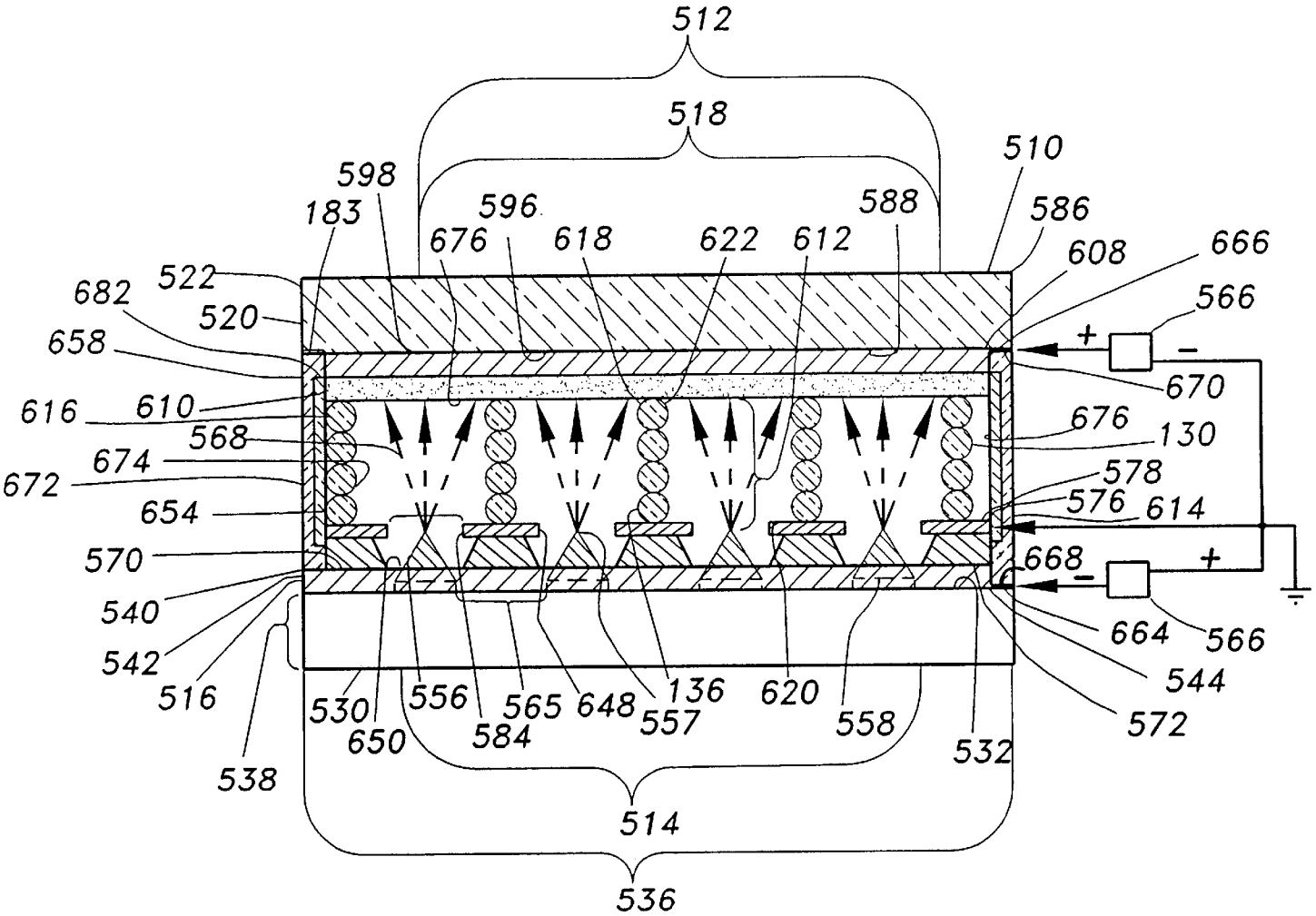
FIG. 2 is a cross-sectional view of the image display panel of FIG. 1, taken along lines 2—2 of FIG. 1.
Figure 3:
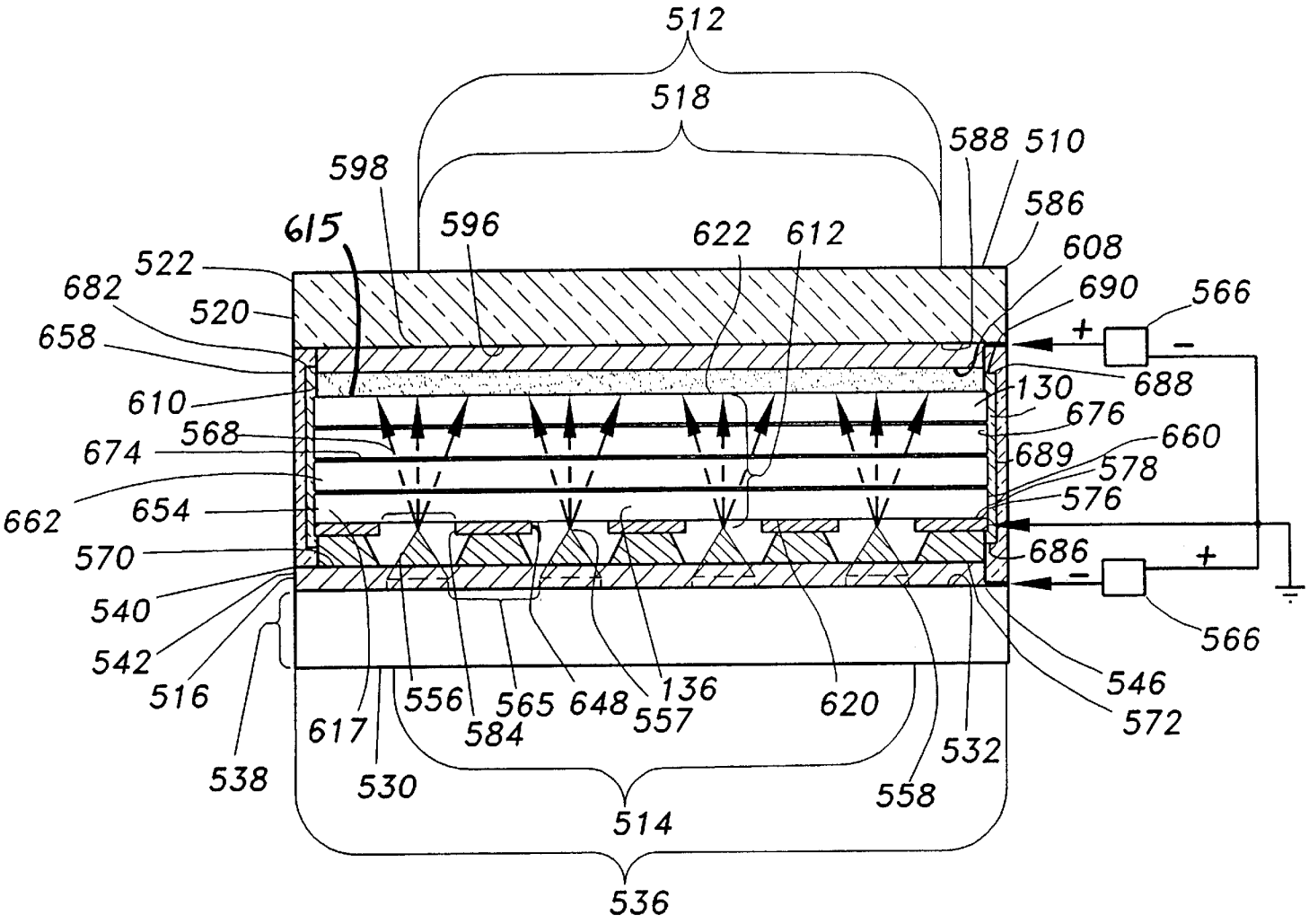
FIG. 3 is a cross-sectional view of the image display panel of FIG. 1, taken along lines 3—3 of FIG. 1.
Figure 4:
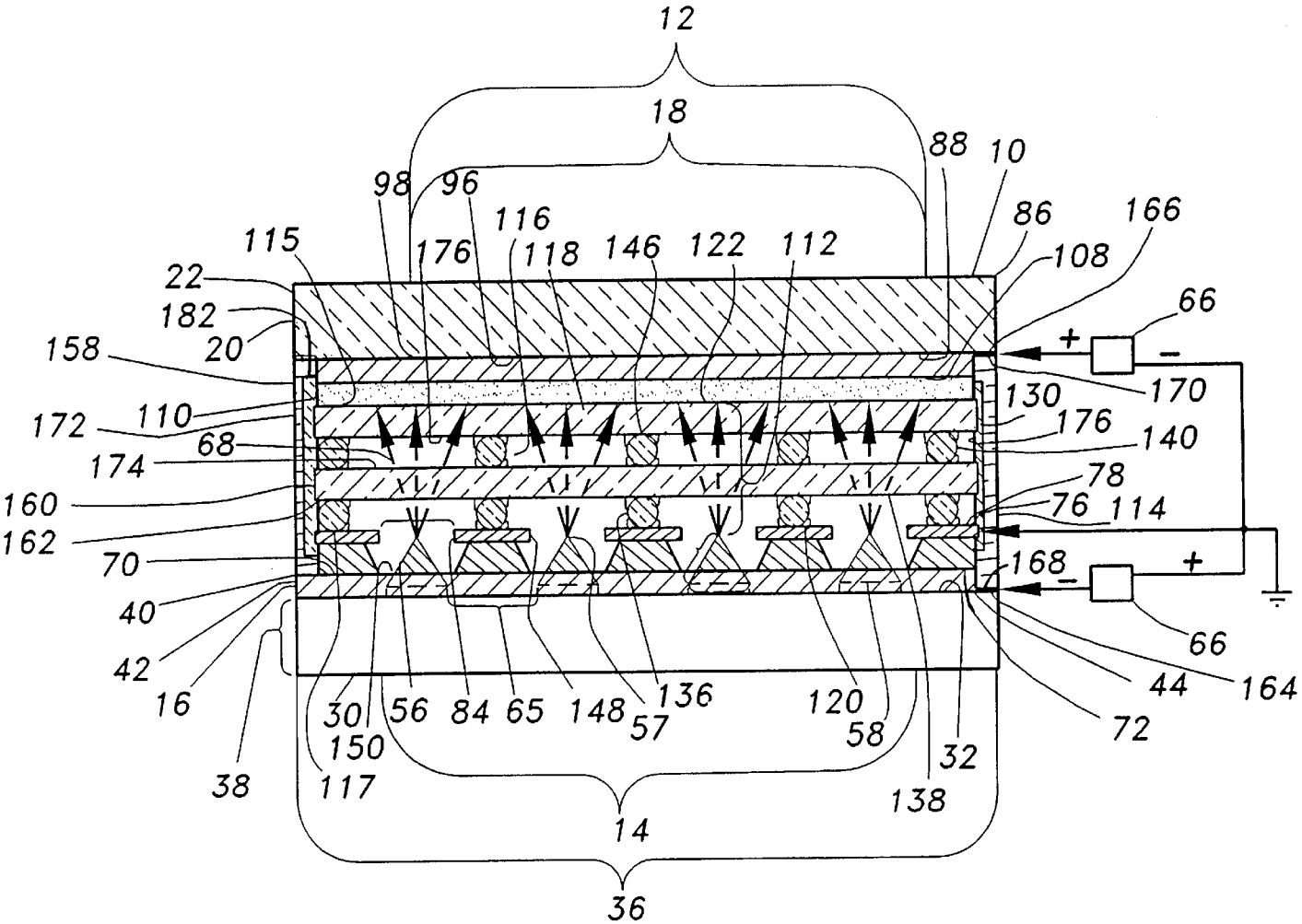
FIG. 4 is a cross-sectional view of a preferred embodiment of an image display panel according to the present invention.

The present invention includes an image display panel 10, 510 shown in FIGS. 1–4. The present invention is useful for a wide variety of image display panels in which individual imaging elements or groups of imaging elements, such as a pixel 12, 512, are formed from a portion 14, 514 of an emitter 16, 516 and a corresponding portion 18, 518 of a display 20, 520, as shown in FIGS. 2–4.

Flat panel displays utilize an addressing scheme to access and configure individual imaging elements or pixels 12, 512 to display information sent from a computer (not shown) or other device to the image display panel 10, 510. Methods and apparatus for transmitting information from a computer or other transmitting device to an image display panel are well known to those skilled in the art and further discussion thereof is not believed to be necessary in view of the present disclosure.

Non-limiting examples of image display panels for which the present invention is useful include passive or active matrix liquid crystal displays (LCDs), electroluminescent displays, gas plasma displays and field emission displays.

Passive matrix addressed LCDs use liquid crystal material to provide the display. Passive LCDs generally have poor contrast, a limited range of viewing angles, and high power consumption for color panels. Active matrix addressed LCDs can have, for example, an array of diodes, thin film transistors (TFTs) or metal-insulator-metal (MIM) devices.

In a gas plasma display, individual display elements or groups of elements are formed in discrete cells which are bounded by intersections of adjacent row and column electrodes. Gas in the region of energized intersecting row and column electrodes is ignited to produce illumination in the corresponding region of the display.

An important aspect of the present invention is the spacer unit, which will be discussed in detail below. To better understand this important aspect of the invention, the environment or image display panel in which such a spacer unit is useful will first be discussed.

The preferred image display panels 10, 510 of the present invention are FEDs or field emission displays 22, 522 such as are shown in FIGS. 1–4. The shape of the image display panel 10, 510 can be generally rectangular, square, circular, or any shape desired. Referring to FIG. 1 to discuss the general overall dimensions of a suitable image display panel, the overall length 24 of the image display panel 10, 510 can be about 0.005 to about 1 meter, and is preferably about 0.1 to about 0.5 meters. The overall width 26 of the image display panel 10, 510 can be about 0.005 to about 1 meter, and is preferably about 0.01 to about 0.5 meters. The overall thickness 28 of the image display panel 10, 510 can be about 0.1 to about 10 millimeters (mm), and is preferably about 1 to about 4 mm. One skilled in the art would understand that the physical dimensions of the image display panel 10, 510 can be greater or less than the dimensions given above depending upon the desired application.

As shown in FIGS. 2–4, the field emission display 22, 522 includes an emitter 16, 516. The emitter 16, 516 includes an electrically insulative substrate 30, 530 which can be formed from an electrically insulating material such as glass or a polymeric material. Non-limiting examples of suitable glass materials include silicate-based glass materials such as soda lime silicate glass and alkaline earth aluminoborosilicate glass. Suitable glass materials include Corning 1737 and 7059 glasses which are commercially available from Corning Glass Works of Corning, N.Y. and Nippon Electric BLC Glass of Nippon Electric, Japan. A detailed explanation of such glass materials is not believed to be necessary for purposes of this application, however, a further discussion of such glass materials is set forth in Moffat, *MRS Bulletin,* Vol.

21, No. 3, March 1996 at pages 31–34, which is hereby incorporated by reference. Optically transparent polycarbonate can be used as an emitter substrate in FPDs which are not subjected to a high internal sealing vacuum. Preferably, the insulative substrate 30, 530 is generally flat, although the interior surface 32, 532 of the insulative substrate 30, 530 can have ridges, protrusions or irregularities, as desired.

The dimensions of the insulative substrate 30, 530 can vary based upon such factors as the desired length 24 and width 26 of the image display panel 10, 510 and selection of the insulating material. Referring to FIGS. 1–4, preferably the length 34, 534 and width 36, 536 of the insulative substrate 30, 530 are generally equal to the length 24 and width 26 of the image display panel 10, 510, respectively, although the length 34, 534 and width 36, 536 of the insulative substrate 30, 530 can be greater than or less than the length 24 and width 26 of the image display panel 10, 510, if desired. The length 34, 534 of the insulative substrate 30, 530 can be about 0.005 to about 1 meter, and is preferably about 0.01 to about 0.5 meters. The width 36, 536 of the insulative substrate 30, 530 can be about 0.005 to about 1 meter, and is preferably about 0.01 to about 0.5 meters. The thickness 38, 538 of the insulative substrate 30, 530 can be about 0.1 to about 10 millimeters (mm), and is preferably about 0.5 to about 2 mm.

The insulative substrate 30, 530 has on at least a portion 40, 540 of its interior surface 32, 532 a conductive layer 42, 542, shown in FIGS. 2–4, preferably comprising a plurality of row conductors 44, 544 and a plurality of column conductors 46, 546, shown in FIG. 1. The conductors 44, 544 and 46, 546 can be formed from thin film conductive materials, such as indium-tin oxide ("ITO"). Typically, suitable indium-tin oxide has a resistivity of about 5 Ω/square inch. The conductors 44, 544 and 46, 546 can be formed upon the interior surface 32, 532 of the insulative substrate 30, 530 by a method such as for example chemical vapor deposition (CVD). Other methods for forming the conductive layer 42, 542 are well known to those skilled in the art and further discussion thereof is not believed to be necessary in view of the present disclosure.

Referring now to FIG. 1 to discuss the general overall dimensions of suitable conductors, the length 48 of the row conductors 44, 544 can be generally equal to the width 36, 536 of the insulative substrate 30, 530 and the length 50 of the column conductors 46, 546 can be generally equal to the length 34, 534 of the insulative substrate 30, 530 although the lengths 48, 50 can vary as desired. The thickness 54 of the conductors 44, 544 and 46, 546 is preferably the minimum needed to reliably conduct energy to the emitter tips 56, 556, and can be about 300 nanometers to about 500 nanometers.

Preferably, in a field emission display such as is shown in FIGS. 1–4, an emitter tip 56, 556 or cathode (field emission site) is positioned at each of the intersections 58, 558 of the respective conductors 44, 544 and 46, 546. Each intersection of a row conductor 44, 544 and column conductor 46, 546 corresponds to a pixel 12, 512 or portion of a pixel. The emitter tip 56, 556 can be formed upon the intersection 58, 558 from a semiconductive material such as silicon, tungsten or diamond by any method known to those skilled in the art. Non-limiting examples of suitable diamond emitters are disclosed in Jaskie, *Materials Bulletin,* Vol. 21, No. 3 (March 1996) at pages 59–64, which is hereby incorporated by reference. Examples of suitable tungsten emitters are disclosed in Cathey, *Information Display,* No. 10, pages 16–20 (1995), which is hereby incorporated by reference.

The emitter tip 56, 556 is preferably conically shaped, although the emitter tip 56, 556 can be pyramidal or any shape having a point 57, 557 for directing a stream of charged particles or energy 68, 568 toward the display 20, 520. The dimensions of suitable emitter tips 56, 556 are well known to those skilled in the art and further discussion thereof is not believed to be necessary. The emitter tips 56, 556 can be positioned at a distance 65, 565 of about 3 to about 5 micrometers from each other, for example.

As shown in FIGS. 2–4, when energy 68, 568 is supplied to the intersection 58, 558 of a row conductor 44, 544 and a column conductor 46, 546 from an energy source 66, 566 the energy is conducted to the corresponding emitter tip 56, 556 which emits energy 68, 568 such as electrons. The energy is accelerated towards the oppositely charged display 20, 520 to provide an image (not shown) on the display 20, 520. Selective energizing of the conductors 44, 544 and 46, 546 is controlled by a controller (not shown), such as an analog controller which varies the intensity of the color of the display 20, 520 by varying the voltage applied to the conductors 44, 544 and 46, 546.

The portion 70, 570 of the conductors 44, 544 and 46, 546 surrounding the emitter tips 56, 556 is preferably coated with or in facing engagement with an insulative layer 72, 572, which can be formed from an electrically insulating material such as glass or a polymeric material by any method well known to those skilled in the art. The thickness of the insulative layer 72, 572 can vary based upon such factors as the insulating material selected and the voltage to be imparted to the conductors 44, 544 and 46, 546. The insulative layer 72, 572 inhibits stray particles such as energy 68, 568 emitted from adjacent emitter tips 56, 556 from migrating to adjacent display areas causing picture distortion.

In the preferred field emission displays shown in FIGS. 2–4, the emitter 16, 516 includes a conductive layer or gate electrode 76, 576 (a low potential anode gate structure) positioned upon the insulative layer 72, 572 surrounding the emitter tips 56, 556. One skilled in the art would understand that a gate electrode may not be required in other types of displays. The gate 76, 576 includes a plurality of apertures 84, 584 through which respective emitter tips 56, 556 are positioned. The point 57, 557 of the emitter tip 56, 556 is preferably generally level with the surface 78, 578 of the gate electrode 76, 576. When a voltage differential is applied from the energy source 66, 566 between the cathode and gate 76, 576, a stream of energy is emitted toward the display 20, 520. Suitable materials, dimensions and methods for forming the gate 76, 576 are well known to those skilled in the art.

As discussed above, the image display panel 10, 510 also comprises a display 20, 520 or anode, shown in FIGS. 1–4. The image display panel 10, 510 is preferably essentially free and more preferably completely free of any insulating or glass panels between the emitter tips 56, 556 and the display 20, 520.

The display 20, 520 includes a transparent, electrically insulative substrate 86, 586 which can be formed from an electrically insulating material such as glass or a polymeric material. The insulative substrate 86 can be formed from such materials as are discussed above for forming the insulative substrate 30. Preferably, the insulative substrate 86,586 is generally flat, although the interior surface 88, 588 of the insulative substrate 86, 586 can have ridges, protrusions or irregularities, as desired.

Referring now to FIG. 1 to discuss the general overall dimensions of the insulative substrate 86, 586, preferably the length 90 and width 92 of the insulative substrate 86, 586 are generally equal to the length 24 and width 26 of the image display panel 10, 510 and/or emitter 16, 516, although the length 90 and width 92 of the insulative substrate 86, 586 can be greater than or less than the length 24 and width 26 of the image display panel 10, 510, if desired. The length 90 of the insulative substrate 86, 586 can be about 0.005 to about 1 meter, and is preferably about 0.01 to about 0.5 meters. The width 92 of the insulative substrate 86, 586 can be about 0.005 to about 1 meter, and is preferably about 0.01 to about 0.05 meters. The thickness 94 of the insulative substrate 86, 586 can be about 0.1 to about 10 millimeters (mm), and is preferably about 0.5 to about 2 mm.

As shown in FIGS. 2–4, the insulative substrate 86, 586 has on at least a portion 96, 596 of its interior surface 88, 588 an electrically conductive layer 98, 598 preferably comprising a plurality of row conductors 100 and a plurality of column conductors 102, shown in FIG. 1. The conductors 100 and 102 can be formed from a conductive material, such as indium-tin oxide, by any method well known to those skilled in the art such as chemical vapor deposition (CVD) mentioned above.

Referring now to FIG. 1 to discuss the general overall dimensions of the conductors 100, 102, the length 104 of the row conductors 100 can be generally equal to the width 92 of the insulative substrate 86, 586 and the length 106 of the column conductors 102 can be generally equal to the length 90 of the insulative substrate 86, 586, although the lengths 104, 106 can vary as desired.

As shown in FIGS. 2–4, the conductive layer 98, 598 has on an interior surface 108, 608 thereof a luminescent material 110, 610 which emits radiation upon some form of excitation, for example by contact with energy 68, 568. Although not believed to be necessary herein, a detailed discussion of luminescent materials can be found in 1 *Van Nostrand's Scientific Encyclopedia,* page 1737 (7th Ed. 1989), which is hereby incorporated by reference. Briefly, the luminescence process involves absorption of energy, excitation of the luminescent material and emission of energy, typically by visible radiation.

As discussed in *Van Nostrand's,* above, non-limiting examples of suitable luminescent materials 110, 610 include photoluminescents which are excited by photons, electroluminescents which are excited by electric fields and cathodoluminescents which are excited by cathode rays. The luminescent material 110, 610 can be applied to the conductive layer 98, 598 by electrophoretic deposition or any other method well known to those skilled in the art.

The luminescent material 110, 610 luminesces in one of three predetermined primary colors—red, blue or green—upon excitation provided by energy 68, 568 received from the emitter 16, 516. Energy from the luminescent material 110, 610 is transferred to the conductive layer 98, 598 to complete the circuit to the energy source 66, 566.

The luminescent materials typically used in FEDs are similar to those used in CRTs. Non-limiting examples of suitable luminescent materials 110, 610 are: $Y_2O_3$—Eu for red color; $Y_3(Al, Ga)_5O_{12}$—Tb for green; $Y_2SiO_5$—Ce for blue; and $Y_2O_2S$—Tb, Sm for white.

As shown in FIGS. 2–4, the average distance 112, 612 between the emitter 16, 516 and the display 20, 520 can be about 200 micrometers. One skilled in the art would understand that this distance 112, 612 can vary based upon such factors as the materials from which the components are formed, the desired intensity of the energized luminescent material and the overall desired dimensions of the image display panel. The voltage differential between the emitter 16, 516 and display 20, 520 can be about 300 to about 1000 volts.

An important aspect of the present invention is a spacer unit 114 (shown in FIGS. 7 and 8) which provides the image display panel 10, 510 with mechanical support against atmospheric and other externally applied pressure on the emitter 16, 516 and display 20, 520 as well as to align the emitter 16, 516 and display 20, 520. The spacer unit 114, 614 comprises a spacer 116, 616 (best shown in FIG. 5) for separating and aligning the emitter 16, 516 and display 20, 520. The spacer 116, 616 is preferably electrically insulative, although the spacer 116, 616 can be semi-conductive or conductive, if desired. The spacer 116, 616 preferably is inexpensive, stable under electron bombardment, capable of withstanding baking temperatures of greater than about 550° C., resistant to thermal cycling, dimensionally accurate so as not to visibly interfere with the operation of the image display panel and easy to assemble, transport and implement. Preferably, the spacer 116 has a high aspect ratio, preferably about 2:1 to about 100:1, and more preferably about 20:1.

Referring to FIGS. 2–4, the spacer 116, 616 comprises one or more assemblies 118, 618. Each assembly 118, 618 has a first side 120, 620, a second side 122, 622 and a third side 162, 662 extending between the first side 120, 620 and the second side 122, 622. The first side 120, 620 of the assembly 118, 618 is adjacent the emitter 16, 516 of the field emission display 10, 610 and the second side 122, 622 of the assembly 118, 618 is adjacent the display 20, 520.

Figure 8:
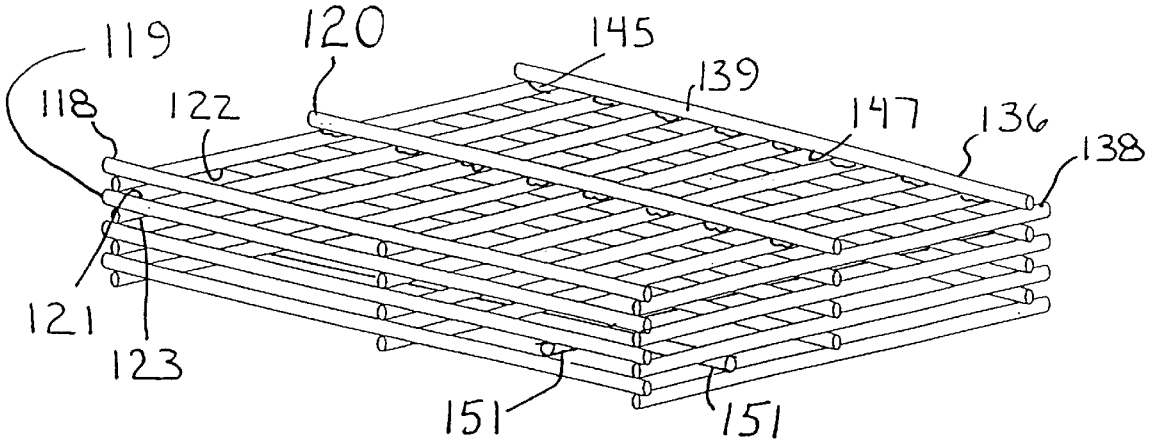
FIG. 8 is an enlarged perspective view of a portion of another alternative embodiment of a spacer having electrodes for use in a spacer unit according to the present invention.

Preferably, in a field emission display, the first side 120, 620 of the assembly 118, 618 is in contact or facing engagement with the surface 78, 578 of the gate electrode 76, 576 of the emitter 16, 516. Also, the second side 122, 622 of the assembly 118, 618 is preferably in facing engagement with the luminescent material 110, 610 or conductive layer 98, 598 of the display 20, 520. The first side 120, 620 and second side 122, 622 of the assembly 118, 618 are preferably generally parallel, however the first side 120, 620 and second side 122, 622 can be positioned at an angle, if desired. Alternatively, the first side 120, 620 or second side 122, 622 can be positioned adjacent to a first side 121 or second side 123 of another assembly 119, as shown in FIG. 8.

Referring to FIG. 5 for a discussion of general dimensions of the assembly 118, 618, the length 124 of the assembly 118, 618 is preferably slightly less than the overall length 24 of the image display panel 10, 510. The length 124 of the assembly 118, 618 can be about 0.005 to about 1 meter, and is preferably about 0.01 to about 0.5 meters. The width 126 of the assembly 118, 618 is preferably slightly less than the overall width 26 of the image display panel 10, 510. The width 126 of the assembly 118, 618 can be about 0.005 to about 1 meter, and is preferably about 0.01 to about 0.5 meters. The thickness 128 of the assembly 118, 618 can be about 1 to about 10 millimeters, and is preferably about 0.4 to about 1 millimeters.

As shown in FIG. 5, the assembly 118, 618 comprises one or more first layers 130, each first layer 130 having a first side 132 and a second side 134. The first layer 130 comprises a plurality of generally parallel, spaced-apart fibers 136. As used herein, the term "fibers" means an individual or a bundle of fibers, filaments, strands, threads, rods, ribbons and combinations thereof. The term "strand" as used herein refers to a plurality of individual filaments 137.

The fibers 136 are preferably electrically insulative. Also, the fibers 136 preferably have high compressive strength, sufficient ductility to withstand processing and assembly, and are substantially free of outgassing tendencies at vacuum pressures typically used to assemble the spacer unit 114, 614 (and are therefore preferably inorganic).

The fibers 136 are preferably generally cylindrical as shown in FIG. 5, although the fibers 136 can have any shape desired, such as triangular, square and rectangular in cross section. The surfaces 139 of the fibers 136 are preferably generally smooth, although the surfaces 139 can have irregularities such as protrusions or indentations.

The number of generally spaced apart fibers 136 can be 2 to as many as desired, although preferably the number of fibers 136 is 2 to about 100, and more preferably about 25 to about 50.

The mean average diameter 141 of each of the fibers 136 (individual or bundle) can be about 5 to about 1000 micrometers, and preferably is about 25 to about 100 micrometers. Fibers 136 of different diameters can be used, if desired. The number of individual filaments 137 in each of the fibers 136 (if each fiber contains a plurality of individual filaments 137) can be one to about 10,000 fibers, and is preferably about 100 to about 1,000 fibers. The spacing 143 between each of the plurality of fibers 136 is about 0.02 to about 50 millimeters, and is preferably about 0.2 to about 30 millimeters.

The fibers 136 of the first layer 130 can be formed from natural materials, man-made materials or combinations thereof which have a deformation or melting temperature which is greater than the processing, assembly and use temperatures to which the image display panel 10, 510 will be subjected. Fibers 136 useful in the present invention are discussed at length in the *Encyclopedia of Polymer Science and Technology,* Vol. 6 (1967) at pages 505–712, which is hereby incorporated by reference.

Suitable man-made fibers can be formed from a fibrous or fiberizable material prepared from inorganic substances, natural organic polymers or synthetic organic polymers as discussed in the *Encyclopedia of Polymer Science and Technology,* Vol. 6 at 506–507. As used herein, the term "fiberizable" means a material capable of being formed into a generally continuous filament, fiber, strand or yarn.

Suitable inorganic fibers are discussed in the *Encyclopedia of Polymer Science and Technology,* Vol. 6 at 610–690 and include ceramics, minerals, polycrystalline and carbon or graphite fibers. Non-limiting examples of suitable ceramics include glass, basalt, alumina, alumina-silica, mullite and silicon carbide. Non-limiting examples of suitable minerals include rock wool, wollastinite and sapphire. Also useful in the present invention are metallic fibers such as aluminum, steel and copper which are coated with an insulative coating and metallic fibers which are non-conducting or poorly conducting. For more information on suitable metallic fibers, see *Encyclopedia of Polymer Science and Technology,* Vol. 6 at 569–570.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, "The Manufacturing Technology of Glass Fibres", (3d Ed. 1993) at pages 30–44, 47–60, 115–122 and 126–135, which are hereby incorporated by reference.

Preferred glass fibers have the filament designations D900, D450 and E225, which are well understood by those skilled in the art. For a detailed explanation of the meanings of these filament designations, see Loewenstein (3d Ed.) at pages 25–27, which is hereby incorporated by reference.

It is understood that combinations of any of the above fibers can be used in the spacer unit 114, 614 and image display panel 10, 510 of the resent invention, if desired.

The present invention will now be discussed generally with reference to the preferred glass fibers, although one skilled in the art would understand that any of the fibers discussed above are also useful in the present invention.

Preferably, one or more coating compositions are present on at least a portion of the surface 139 of the glass fibers 136 to protect the surface from abrasion during processing and assembly of the spacer. Non-limiting examples of suitable coating compositions include sizing compositions and secondary coating compositions. As used herein, the terms "size", "sized" or "sizing" refer to the aqueous or non-aqueous composition applied to the filaments immediately after formation of the glass fibers. The term "secondary coating" refers to a coating composition applied secondarily to one or a plurality of strands of glass fibers after the sizing composition is applied, and preferably at least partially dried.

Typical sizing compositions can include as components film-formers, lubricants, waxes, coupling agents, emulsifiers, antioxidants, ultraviolet light stabilizers, colorants, antistatic agents and water, to name a few. Non-limiting examples of suitable sizing compositions are disclosed in *Loewenstein* (3d Ed.) at pages 237–289 and U.S. Pat. Nos. 4,390,647 and 4,795,678, each of which is hereby incorporated by reference.

Preferred sizing compositions for use herein are those typically used for textile applications which generally include starch as the film former, wax and non-ionic lubricant components. Useful starches include those prepared from potatoes, corn, wheat, waxy maize, sago, rice, milo and mixtures thereof. Non-limiting examples of useful starches include Kollotex 1250 (a low viscosity, low amylose potato-based starch etherified with ethylene oxide which is commercially available from AVEBE of the Netherlands), National 1554 (a high viscosity, low amylose crosslinked potato starch), Hi-Set 369 (a low viscosity propylene oxide modified corn starch having an amylose/amylopectin ratio of about 55/45), Hylon and Nabond high viscosity starches (which are commercially available from National Starch and Chemical Corp. of Bridgewater, N.J.), and Amaizo starches which are commercially available from American Maize Products Company of Hammond, Ind.

The wax component of the sizing composition can include one or more aqueous soluble, emulsifiable or dispersible waxes. Examples of such waxes include vegetable, animal, mineral, synthetic or petroleum waxes. Useful petroleum-derived microcrystalline waxes are commercially available from Petrolite Corp. of Tulsa, Okla. and Michelman, Inc. of Cincinnati, Ohio.

Non-limiting examples of useful non-ionic lubricants include vegetable oils and hydrogenated vegetable oils, such as cottonseed oil, corn oil and soybean oil (Eclipse 102 hydrogenated soybean oil which is commercially available from Van den Bergh Foods Company of Lisle, Ill.); trimethylolpropane triesters; pentaerythritol tetraesters; derivatives and mixtures thereof.

The sizing can be applied in many ways, for example by contacting the filaments with a static or dynamic applicator, such as a roller or belt applicator, spraying or other means. See *Loewenstein* (3d Ed.) at pages 165–172, which is hereby incorporated by reference.

The sized fibers are preferably dried at room temperature or at elevated temperatures. Drying of glass fiber forming packages or cakes is discussed in detail in *Loewenstein* (3d Ed.) at pages 219–222, which are hereby incorporated by reference. For example, the forming package can be dried in an oven at a temperature of about 104° C. (220° F.) to about 160° C. (320° F.) for about 10 to about 24 hours to produce glass fiber strands having a dried residue of the composition thereon. The temperature and time for drying the glass fibers will depend upon such variables as the percentage of solids in the sizing composition, components of the sizing composition and type of glass fiber. The sizing is typically present on the fibers in an amount between about 0.1 percent and about 5 percent by weight after drying.

Suitable ovens or dryers for drying glass fibers are well known to those skilled in the art. The dryer removes excess moisture from the fibers 136 and, if present, cures any curable sizing or secondary coating composition components.

After drying, the sized glass strands can be gathered together into bundles of generally parallel fibers (roving), twisted into a yarn or woven into a cloth. The strands can be twisted by any conventional twisting technique known to those skilled in the art, for example by using twist frames. Generally, twist is imparted to the strand by feeding the strand to a bobbin rotating at a speed which would enable the strand to be wound onto the bobbin at a faster rate than the rate at which the strand is supplied to the bobbin. Generally, the strand is threaded through an eye located on a ring which traverses the length of the bobbin to impart twist to the strand, typically about 0.5 to about 4 turns per inch. Fabric can be woven using any conventional loom, such as a shuttle loom, air jet loom, rapier loom or other weaving machine. The roving or twisted glass fibers can be treated with a secondary coating composition which is different from the sizing composition.

As shown in FIGS. 4 and 5, the assembly 118 preferably also includes one or more second layers 140, each second layer having a first side 142 and a second side 144. The second layer 140 comprises a plurality of generally parallel, spaced-apart fibers 138, which can be the same or different from the fibers 136 of the first layer 130. Suitable materials for fibers 138 are the same as those discussed above for the fibers 136 of the first layer 130. The fibers 138 of the second layer 140 can also have similar physical characteristics and dimensions as the fibers 136 of the first layer 130.

The second side 134 of the first layer 130 is adjacent to and preferably in facing engagement with the first side 142 of the second layer 140. The fibers 136 of the first layer 130 are positioned to form a plurality of intersections 146 with the fibers 138 of the second layer 140, for example by positioning the fibers 136, 138 at an angle ranging from about 10 to about 170 degrees (preferably about 90 degrees as shown in FIG. 5) or by weaving the fibers 136, 138 as shown in FIG. 7.

The fibers 136 of the first layer 130 can be, but preferably are not, bonded to the corresponding fibers 138 of the second layer 140 at the intersections 146 thereof by a bonding composition 145, shown in FIG. 8. By omitting a bonding composition from the assembly 118, 618, raw material and assembly costs can be reduced, assembly of the spacer unit 114, 614 can be simplified and contamination of the interior of the image display panel 10, 510 by particles of bonding composition which detach from the bonded fibers can be prevented.

If a bonding composition 145 is present, it can be applied to the fibers 136 of the first layer 130 and/or the fibers 138 of the second layer 140. The bonding composition 145 is any material which secures or adheres intersecting portions of the fibers 136 of the first layer 130 with the fibers 138 of the second layer 140, which will be discussed in detail below. The bonding composition 145 is an adhesive or curable composition which can be selected from coupling agents, cementitious materials or glues, gels (such as sol-gels), cross-linking agents and combinations thereof.

The term "adhesive" as used herein means any substance, inorganic or organic, natural or synthetic, that is capable of bonding other substances together by surface attachment. See *Hawley's Condensed Chemical Dictionary* at page 23 (12th Ed. 1993), which is hereby incorporated by reference. As used herein, the term "curable" means that (1) the components of the bonding composition are capable of being at least partially dried by air and/or heat; and/or (2) the components of the bonding composition and/or glass fibers are capable of being crosslinked to each other to change the physical properties of the components. See *Hawley's Condensed Chemical Dictionary* at page 331 (12th Ed. 1993), which is hereby incorporated by reference. The bonding composition 145 can be cured by heating to a predetermined bonding temperature which is a characteristic of the material selected, radiation and/or by a crosslinking agent.

As used herein, the term "sol-gel" means a suspension of small colloidal particles formed in a solution which are linked together into chains and three-dimensional networks that fill the liquid phase as a gel. L. Hench et al. (Ed.), *Science of Ceramic Chemical Processing,* (1986) at page 5, which is hereby incorporated by reference. The phrase "cross-linking agent" as used herein means an agent which attaches two chains of polymer molecules by bridges, composed of either an element, a group or a compound, which join certain carbon atoms of the chains by primary chemical bonds. See *Hawley's Condensed Chemical Dictionary* at page 325 (12th Ed. 1993), which is hereby incorporated by reference.

The bonding composition 145 can additionally include one or more components of a conventional sizing composition, discussed above, if desired. The bonding composition 145 can be applied to the fibers 136 and/or 138 neat or with a solvent or carrier such as water. Alternatively, the bonding composition 145 can be a glass cladding which has a deformation or melting temperature which is less than the deformation or melting temperature of the fibers 136, 138.

Preferably, the bonding composition 145 is a coupling agent such as a functional organo silane coupling agent, transition metal coupling agent, phosphonate coupling agent, amino-containing Werner coupling agent and mixtures thereof. Such coupling agents can lubricate the fibers prior to curing to inhibit and protect the fibers from abrasion. These coupling agents typically have dual functionality. Each metal or silicon atom has attached to it one or more groups which can react or compatibilize with the fiber or glass surface, the components of the sizing composition, the other components of the bonding composition, if any, and/or by condensation with other, if any, hydrolyzable groups of the bonding composition. As used herein, the term "compatibilize" means that the groups are chemically attracted, but not bonded, to the fiber or glass surface, the components of the sizing composition and/or the other components of the bonding composition, for example by polar, wetting or solvation forces. Examples of hydrolyzable groups include:

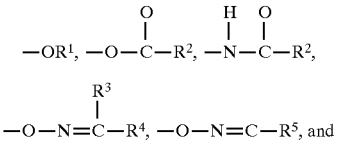

the monohydroxy and/or cyclic $C_2$–$C_3$ residue of a 1,2- or 1,3 glycol, wherein $R^1$ is $C_1$–$C_3$ alkyl; $R^2$ is H or $C_1$–$C_4$ alkyl; $R^3$ and $R^4$ are independently selected from H, $C_1$–$C_4$ alkyl or $C_6$–$C_8$ aryl; and $R^5$ is $C_4$–$C_7$ alkylene. Examples of suitable compatibilizing or functional groups include epoxy, glycidoxy, mercapto, cyano, allyl, alkyl, urethano, halo, isocyanato, ureido, imidazolinyl, vinyl, acrylato, methacrylato, amino or polyamino groups.

Functional organo silane coupling agents are preferred for use in the present invention. Examples of suitable functional organo silane coupling agents include 3-aminopropyldimethylethoxysilane, gamma-aminopropyltriethoxysilane, gamma-aminopropyltrimethoxysilane, beta-aminoethyltriethoxysilane, N-beta-aminoethyl-aminopropyltrimethoxysilane, gamma-isocyanatopropyltriethoxysilane, vinyl-trimethoxysilane, vinyl-triethoxysilane, allyl-trimethoxysilane, mercaptopropyltrimethoxysilane, mercaptopropyltriethoxysilane, glycidoxypropyltriethoxysilane, glycidoxypropyltrimethoxysilane, 4,5-epoxycyclohexyl-ethyltrimethoxysilane, ureidopropyltrimethoxysilane, ureidopropyltriethoxysilane, chloropropyltrimethoxysilane, and chloropropyltriethoxysilane.

Non-limiting examples of useful functional organo silane coupling gents include epoxy (A-187 gamma-glycidoxypropyltrimethoxysilane), methacrylate (A-174 gamma-methacryloxypropyltrimethoxysilane) and amino (A-1100 gamma-aminopropyltriethoxysilane) silane coupling agents, each of which are commercially available from OSi Specialties, Inc. of Tarrytown, N.Y. Preferred organo silane coupling agents include bis silanes such as bis (trimethoxysilylpropyl) amine, which are commercially available from OSi Specialties, Inc. The organo silane coupling agent can be at least partially hydrolyzed with water prior to application to the fiber, preferably at about a 1:1 stoichiometric ratio or, if desired, applied in unhydrolyzed form.

Preferably, the bonding composition 145 is essentially free of any reactive metallic materials such as sodium or potassium when the bonding composition 145 includes an organo silane coupling agent.

Suitable transition metal coupling agents include titanium, zirconium and chromium coupling agents. Non-limiting examples of suitable titanate coupling agents include titanate complexes such as Ken-React KR-44, KR-34 and KR-38; suitable zirconate coupling agents include Ken React NZ-97 and LZ-38, all of which are commercially available from Kenrich Petrochemical Company. Suitable chromium complexes include Volan which is commercially available from E.I. duPont de Nemours of Wilmington, Del. The amino-containing Werner-type coupling agents are complex compounds in which a trivalent nuclear atom such as chromium is coordinated with an organic acid having amino functionality. Other metal chelate and coordinate type coupling agents known to those skilled in the art can be used herein.

The amount of coupling agent can be 0 to about 100 weight percent of the bonding composition on a total solids basis, and is preferably about 10 to about 80 weight percent.

Non-limiting examples of cementitious materials useful in the present invention include cements such as devitrifying and non-devitrifying glass frits which are commercially available from SEM-COM Co., Inc. of Toledo, Ohio or Ferro Corporation of Cleveland, Ohio. Other cementitious materials useful in the present invention include silicates, such as sodium silicate or potassium silicate, and silicones. The amount of cementitious material in the bonding composition can be 0 to about 100 weight percent of the bonding composition on a total solids basis, and is preferably about 10 to about 60 weight percent.

Non-limiting examples of sol-gels useful in the present invention include partially or fully hydrolyzed organo functional silanes such as HYDROSIL® products which are commercially available from Huls America of Piscataway, N.J. Alternatively, the sol-gel can be the reaction product of tetraorthosilicate (TEOS) with pH adjusted water. The amount of gel in the bonding composition can be 0 to about 100 weight percent of the bonding composition on a total solids basis, and is preferably about 1 to about 5 weight percent.

Non-limiting examples of cross-linking agents useful in the present invention include melamine formaldehyde, blocked isocyanates such as Baybond XW 116 or XP 7055, epoxy crosslinkers such as Witcobond XW by Witco Corp., and polyesters such as Baybond XP-7044 or 7056, which are commercially available from Bayer of Pittsburgh, Pa. The amount of cross-linking agent in the bonding composition can be 0 to about 100 weight percent of the bonding composition on a total solids basis, and is preferably about 10 to about 60 weight percent.

The bonding agent can include a conductive dopant for dissipating any static charge formed during assembly of the FPD to ground. A non-limiting example of a suitable dopant is carbon black.

The bonding composition is applied to at least a portion 147 of the surface 139 of the fibers 136 of the first layer 130 and/or the fibers 138 of the second layer 140 in an amount effective to coat or impregnate at least the portion 147 of the fibers 136, 138. The bonding composition can be conventionally applied by dipping the fibers 136 and/or 138 in a bath containing the composition, by spraying the composition upon the fibers or by contacting the fibers with a static or dynamic applicator such as a roller or belt applicator, for example. The coated fibers can be passed through a die to remove excess bonding composition from the fibers and/or dried as discussed above for a time sufficient to at least partially dry or cure the bonding composition.

The amount of the bonding composition 145 applied to the fiber(s) 136, 138 can be about 1 to about 200 weight percent based upon the weight of the fiber, and preferably is about 5 to about 10 weight percent.

As shown in FIG. 6, the assembly 118, 618 can include additional layers 149 which intersect the first and second layers 130, 140 at an angle ranging from about 10 to about 170 degrees. The assembly 118, 618 can also include one or more electrodes 151, shown in FIG. 8. The electrodes 151 can be formed from a metallic material and can be for example, wire, foil is and/or mesh. The electrodes 151 can be positioned by stacking or weaving within the assembly 118, 618.

The assembly 118, 618 has a plurality of passageways 148, 648, best shown in FIGS. 2–5. Each passageway 148, 648 is bounded by the adjacent fibers 136 of the first layer 130 and, where one or more second layers 140 are present, by the adjacent fibers 138 of the second layer 140 and the corresponding intersections 146. The passageways 148, 648 are generally perpendicular to the fibers 136 of the first layer 130 and the fibers 138 of the second layer 140, such that when the assembly 118, 618 is positioned between the emitter 16, 516 and the display 20, 520 of the image display panel 10, 510 as shown in FIGS. 2–4, the passageways 148, 648 permit the passage of energy 68, 568 or other particles therethrough between the emitter 16, 516 and the display 20, 520. As shown in FIGS. 2–4, each emitter tip 56, 556 is positioned at an end 150, 650 of a respective passageway 118, 618 spaced apart from the display 20, 520.

The shape of the passageway 148, 648 is determined by the configuration of the fibers 136, 138 in the assembly 118, 618. For example, for the configuration shown in FIGS. 4 and 5, the passageways 148 are generally square. Alternatively, the passageways 148 can be triangular as shown in FIG. 6, rectangular or octagonal, for example. Referring to FIG. 5 for a discussion of the dimensions of the passageways 148, 648, the depth 152 of the passageway 148 is preferably generally equal to the thickness 128 of the assembly 118, 618. The passageways 148, 648 have a high aspect ratio, generally about 20 to about 1, i.e., the ratio of the depth 152 to the average diameter 156 of the passageway 148, 648.

Referring now to FIGS. 2–4, 9 and 10, the spacer unit 114, 614 includes a sealing frame 158, 658 positioned about and engaging at least a portion 160, 660 of a periphery or third side 162, 662 of the spacer 116, 616. The spacer 116, 616 can include one or more sides 162, 662, as desired. As shown in FIG. 1, for example, the spacer 616 has four sides 662.

The sealing frame 158, 658 has a first end 164, 664 and a second end 166, 666. The first end 164, 664 of the sealing frame 158, 658 is positioned adjacent to and preferably engages a portion 168, 668 of the emitter 16, 516. The second end 166, 666 of the sealing frame 158, 658 is positioned adjacent to and preferably engages a portion 170, 670 of the display 20, 520.

Figure 9:
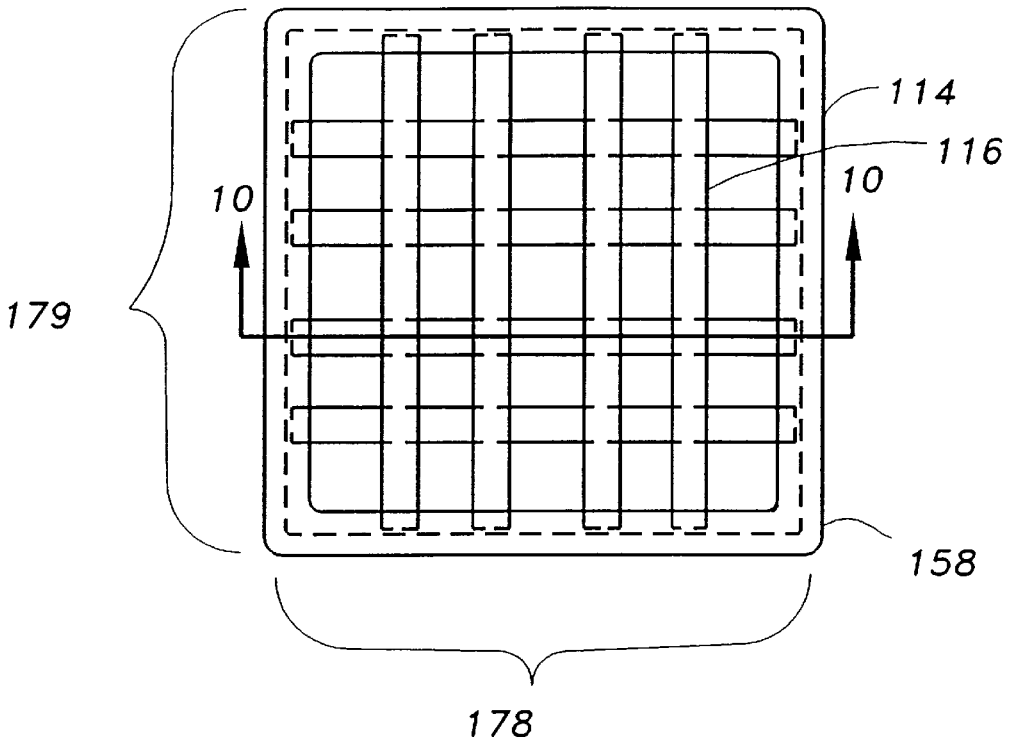
FIG. 9 is an enlarged top plan view of a spacer unit according to the present invention.
Figure 10:
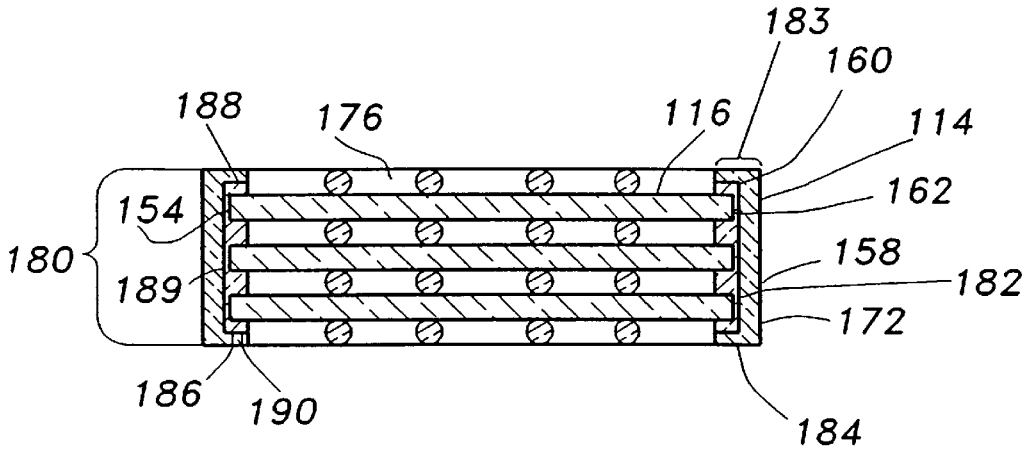
FIG. 10 is a cross-sectional view of the spacer unit of FIG. 9 taken along lines 10—10 of FIG. 9.

Referring to FIGS. 9 and 10 for a discussion of suitable dimensions for the sealing frame 158, 658, the width 178 and length 179 of the sealing frame 158, 658 are preferably slightly greater than the larger of the corresponding lengths and widths of the other components of the image display panel 10, 510, such as the emitter 16, 516, display 20, 520 and spacer 116, 616 components, such that the emitters 16, 516 can be hermetically sealed between the interior 176, 676 of the sealing frame 158, 658, the emitter substrate 30, 530 and the display substrate 86, 586. The width 178 of the sealing frame 158, 658 can be about 0.005 to about 1 meter. The length 179 of the sealing frame 158, 658 can be about 0.005 to about 1 meter.

The height 180 of the sealing frame 158, 658 is preferably generally greater than the thickness 128 of the spacer 116, 616 and preferably corresponds generally to the distance between the emitter substrate 30, 530 and display substrate 86, 586. The height 180 of the sealing frame 158, 658 can be about 0.01 to about 10 millimeters. The thickness 183 of the sealing frame 158, 658 can be about 0.3 to about 10 millimeters, and is preferably about 0.5 to about 1 millimeter. The height 180 and thickness 183 of the sealing frame 158, 658 should not influence the spacing between the emitter 16, 516 and the display 20, 520 which is maintained by the spacer 116, 616.

The sealing frame 158, 658 comprises a support 182, 682 and sealing material 172, 672. The support 182, 682 has a first end 186, 686, a second end 188, 688 and a side 189, 689 therebetween. The support 182, 682 is formed from a hardenable material which when hardened maintains the fibers 136 and/or 138 in the desired alignment. As used herein, "hardenable material" means any material which is capable of being increased in strength or hardness by curing with heat, radiation such as ultraviolet radiation, or chemical reaction such as crosslinking.

The support 182, 682 can be formed, for example, from a hardenable material having a predetermined deformation temperature upon application of heat which is less than a predetermined deformation temperature of the other components of the image display panel 10, 510, such as the emitter 16, 516, display 20, 520 and spacer 116, 616. As used herein, the terms "deformation" and "deformable" mean that the support 182, 682 softens or deforms upon exposure to an external agent, for example heat, radiation and/or a chemical agent, such as a cross-linking agent as discussed above or a reaction promoter, and resolidifies or hardens upon removal or consumption of the external agent to a hardness sufficient to resist the external forces or pressure to which the image display panel 10 is to be subjected.

The hardenable material can be, for example, any organic or inorganic cement, and is preferably a devitrifying or vitrifying glass frit, such as SCA-5 lead silicate glass which has a deformation temperature or softening point of about 730° C. and which is commercially available from SEM-COM Co., Inc. Preferably the deformation temperature of the hardenable material is about 300° to about 750° C., and more preferably about 450° to about 525° C. The deformation temperature of the hardenable material depends upon the material selected. The deformation temperatures of the other components of the image display panel 10, 510, such as the emitter 16, 516, display 20, 520 and spacer 116, 616, are greater than the deformation temperature of the hardenable material or greater than about 550° C. to minimize distortion of the components.

The hardenable material from which the support 182, 682 is formed is positioned about the first end 115, 615, second end 117, 617 and third side(s) 162, 662 of the spacer 116, 616 to align the fibers 136, 138 of the spacer 116, 616 and is hardened as discussed above by, for example, application of heat, radiation or a crosslinking agent to harden the support 182, 682 such that the fibers 136, 138 are secured and aligned and movement of the individual fibers 136, 138 of the spacer 116, 616 relative to each other is inhibited. The amount of hardenable material used to form the support 182, 682 can vary based upon such factors as the particular hardenable material selected, its physical characteristics and the environment to which the image display panel 10, 510 will be subjected.

The sealing frame 158, 658 has a sealing material 172, 672 positioned upon at least a portion 190, 690 of the first end 186, 686 and/or the second end 188, 688 of the support 182, 682. The sealing material 172, 672 adheres or bonds the support 182, 682 to the emitter 16, 516 and display 20, 520, such that when the sealing frame 158, 658 and spacer 116, 616 are positioned between the emitter 16, 516 and the display 20, 520, the sealing frame 158, 658 provides an essentially sealed region 174, 674 between the emitter 16, 516 and the display 20, 520. In other words, the first end 164, 664 of the sealing frame 158, 658 is positioned adjacent to a portion of the emitter 16, 516 and the second end 166, 666 is positioned adjacent to a portion of the display 20, 520, such that when the sealing frame 158, 658 and spacer 116, 616 are positioned between the emitter 16, 516 and the display 20, 520 of an image display panel 10, 510, the sealing frame 158, 658 provides an essentially sealed region 174, 674 between the emitter 16, 516 and the display 20, 520.

The sealing material 172, 672 can be any material which is different from the hardenable material from which the support 182, 682 is formed. The sealing material 172, 672 can be a hardenable material such as those discussed in detail above, however the sealing material 172, 672 must harden under conditions which do not adversely affect the hardened support 182, 682.

For example, the sealing material 172, 672 can be a hardenable material having a predetermined deformation temperature which is less than the predetermined deformation temperature of the hardenable material from which the support is formed, such as for example by using SCB-2 lead silicate glass which has a deformation temperature or softening point of about 450° C. as a sealing material with SCA-5 as the support material. Alternatively, the sealing material 172, 672 can be a hardenable material which is cured by application of radiation or a crosslinking agent. The sealing material can be a cement such as potassium silicate or sodium silicate or a coupling agent such as are discussed in detail above, for example a functional organo silane coupling agent.

The sealing material 172, 672 is preferably formed from a material having a predetermined deformation temperature which is less than a predetermined deformation temperature of a component of the image display panel 10, 510 selected from the group consisting of the emitter 16, 516, the display 20, 520, the spacer 116, 616 and the support 182, 682, such that when (i) the support 182, 682 and the spacer 116, 616 are positioned between the emitter 16, 516 and the display 20, 520 and (ii) the sealing material 172, 672 is heated to a temperature greater than the predetermined deformation temperature of the sealing material 172, 672 but less than the predetermined deformation temperature of a component of the image display panel 10, 510 selected from the group consisting of the emitter 16, 516, the display 20, 520, the spacer 116, 616 and the support 182, 682, the sealing material 172, 672 provides an essentially sealed region 174, 674 between the spacer 116, 616, the emitter 16, 516 and the display 20, 520.

Pressure can also be applied to the sealing material 172, 672 prior, during or subsequent to heating to consolidate and further strengthen the spacer unit 114, 614. A non-limiting example of a suitable apparatus for applying pressure to the sealing material is a heated lamination press, such as is commercially available from Tetrahedron Corporation of San Diego, Calif. The pressure applied to the sealing material 172, 672 depends upon such factors as the type of sealing material and temperature and time of heating the sealing material.

The sealing material 172, 672 can be applied to the support 182, 682 by any conventional means well known to those skilled in the art, such as by spraying, coating and dipping.

The amount of sealing material 172, 672 applied to the support 182, 682 can vary based upon such factors as the particular sealing material and support material selected, the desired resistance of the sealing frame 158, 658 to distortion from pressure, which depends in part upon the thickness 183 of the sealing frame 158, 658 (discussed above), and other forces to which the image display panel 10, 510 will be subjected. For example, the amount of sealing material 172 can be about 1 to about 1000 grams.

When the sealing frame 158, 658 and spacer 116, 616 are positioned between the emitter 16, 516 and the display 20, 520 and the sealing material 172, 672 is hardened, the sealing material 172, 672 provides an essentially sealed region 174, 674 between the emitter 16, 516 and the display 20, 520 which encloses the spacer 116, 616 and interior components of the image display panel 10, 510, such as the emitter tips 56, 556.

As used herein, the phrase "essentially sealed region" means that the space between the emitter 16, 516 and the display 20, 520 is generally greater than about 90 percent by area sealed by the frame 158, 658 around the periphery 181, 681 of the image display panel 10 (shown in FIG. 1), and preferably is fully or hermetically sealed if the process is conducted under a vacuum. If the image display panel 10, 510 is not assembled under vacuum, the unsealed portion can be used to evacuate the interior 176, 676 of the image display panel 10, 510. Alternatively, a small aperture can be present in the emitter 16, 516 and/or display 20, 520 through which the interior 176, 676 of the image display panel 10, 510 can be evacuated.

Preferably, for a field emission display, the vacuum pressure in the interior 176, 676 of the image display panel 10, 510 is less than about $10^{-5}$ torr, and more preferably less than about $10^{-6}$ torr. The interior 176, 676 of the sealed region 174, 674 which is under vacuum contains an inert gas, such as argon.

Preferably, the sealing unit 114, 614 is self-leveling when positioned between the emitter 16, 516 and display 20, 520 and the sealing material 172, 672 is heated to the predetermined deformation temperature of the sealing material, i.e., the sealing material 172, 672 deforms such that the first side 120, 620 of the spacer assembly 118, 618 is adjacent to or engages the emitter 16, 516 and the second side 122, 622 of the spacer assembly 118, 618 is adjacent to or engages the display 20, 520. The spacer 116, 616 preferably is self-aligned by alignment of the sealing unit 114, 614 with the emitter 16, 516 and display 20, 520.

While the spacer unit of the present invention has been discussed in detail with regard to its use in a field emission display, one skilled in the art would understand that the spacer unit of the present invention is also useful in other image display panels, such as liquid crystal displays, electroluminescent displays and gas plasma displays. Methods for using the spacer unit of the present invention with these and other types of image display panels would be understood by one skilled in the art in view of the above disclosure and further discussion thereof is not believed to be necessary. For example, in a gas plasma display panel the passageways of the spacer are aligned with the emitter and display elements.

A method for making a spacer unit according to the present invention will now be discussed. One skilled in the art would understand that other methods can be used for making the above spacer unit.

Figure 11:
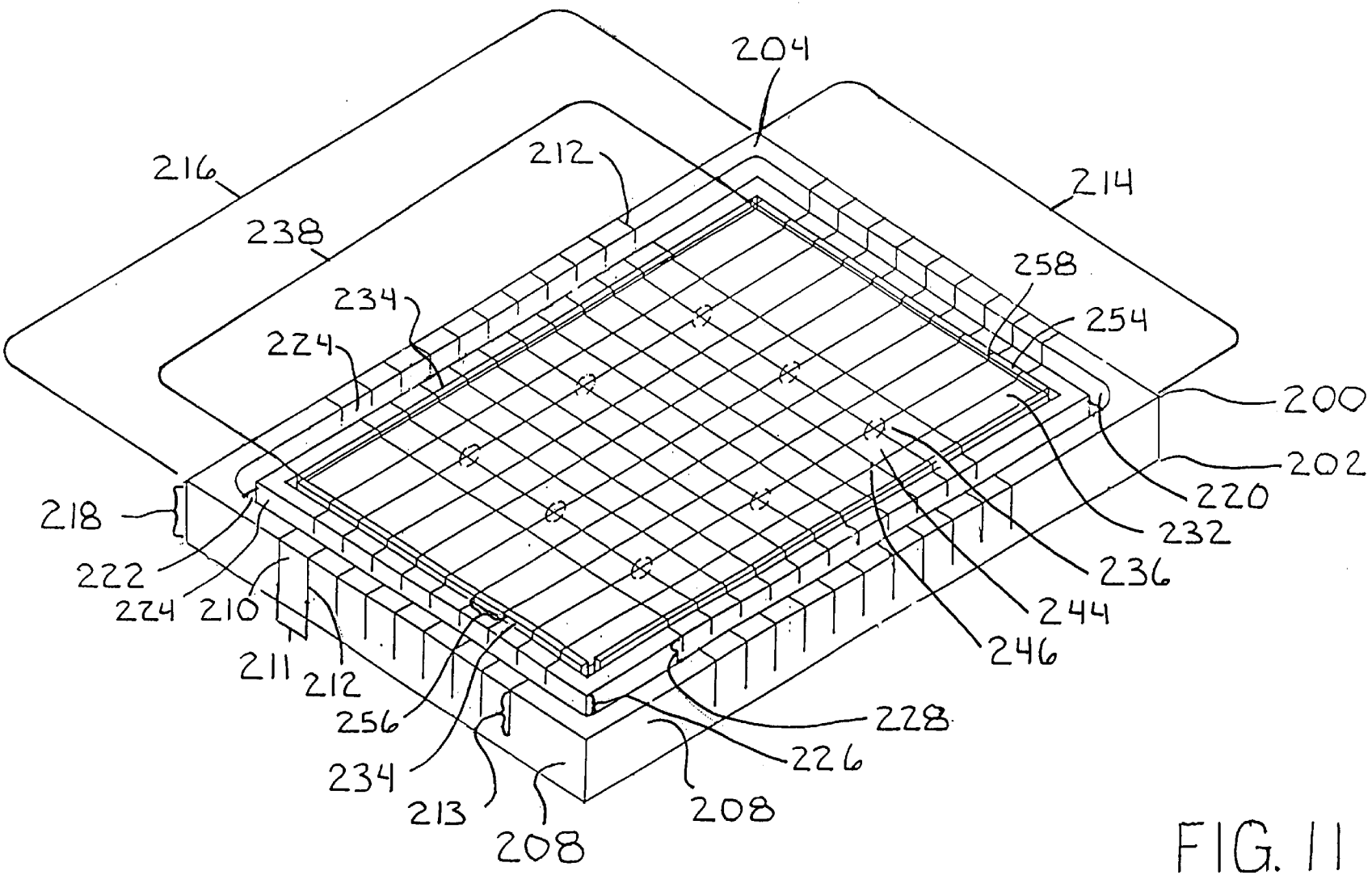
FIG. 11 is an enlarged perspective view of a mandrel for making a spacer unit according to the present invention.

As shown in FIG. 11, a mandrel 200 for filament winding a spacer unit 114, 614 according to the present invention is provided. The mandrel 200 includes a base 202. The base 202 has a top 204, bottom 206 (shown in FIG. 14) and four sides 208 therebetween. One skilled in the art would understand that the number of sides can vary, for example from 3 which provides triangular passageways to 8 which provides octagonal passageways, to provide spacers 116, 616 of different configurations.

The base 202 of the mandrel 200 can be formed from any rigid material or combination of rigid materials which resist deformation during winding and any subsequent heating or curing steps for the spacer and spacer unit. Suitable materials for the base 202 include ceramics such as silicon and alumina, metals such as aluminum and steel, polymers which resist deformation such as DELRIN® acetal, which is commercially available from duPont, graphite and combinations thereof.

Figure 12:
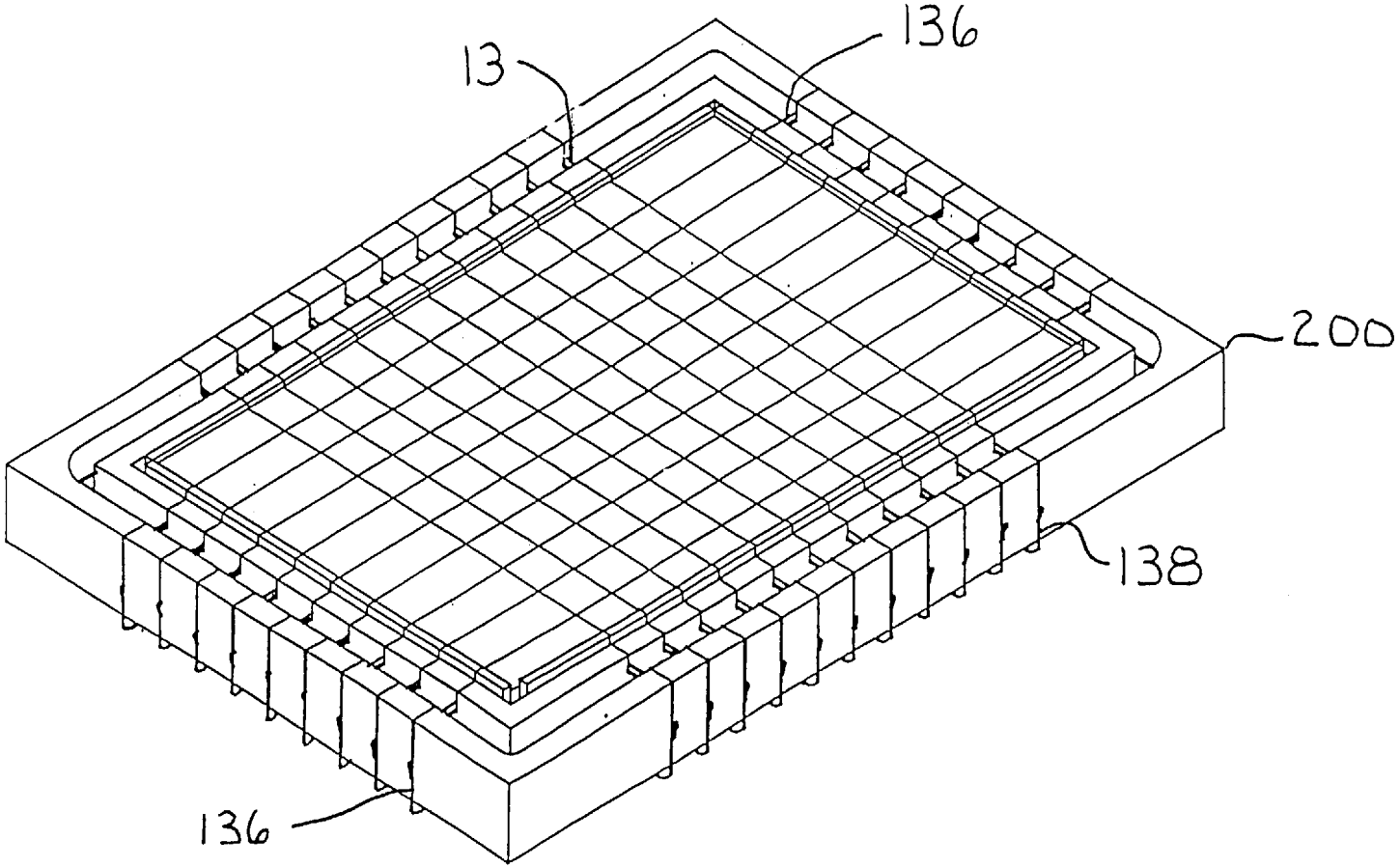
FIG. 12 is an enlarged perspective view of the mandrel of FIG. 11 having a plurality of fibers wound thereon according to the present invention.
Figure 14:
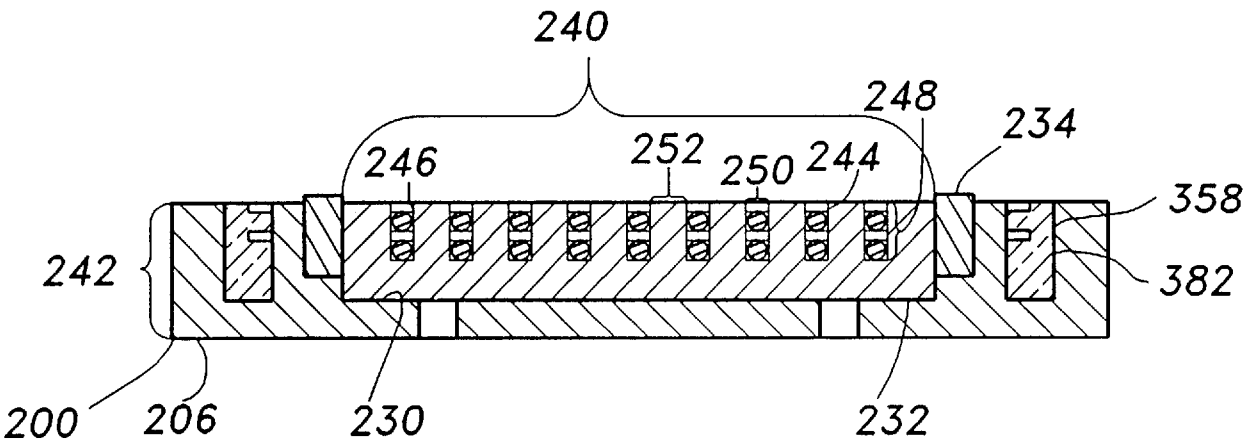
FIG. 14 is a cross-sectional view of the mandrel of FIG. 13, taken along lines 14—14 of FIG. 13.

Referring to FIG. 11, the top 204 and the upper portion 210 of the sides 208 include a plurality of slots 212 for receiving the fibers 136, 138 therein during filament winding of the spacer 116. The diameter of the slots 212 corresponds generally to and is preferably slightly larger than the diameter of the fibers 136, 138. The diameter of the slots 212 permits the fibers 136, 138 to be stacked generally perpendicularly to the sides 208, as shown in FIGS. 12 and 14. The diameter of the slots 212 can be about 5 to about 200 micrometers, and is preferably about 15 to about 80 micrometers.

The depth 213 of the slots 212 can vary, but preferably corresponds generally to the desired height of the spacer 116 and can be about one-fifth to about one-half of the height 218 of the mandrel 200. The slots 212 preferably traverse the entire width of the top 204 of the mandrel 200, as shown in FIG. 11.

The distance 211 between the slots 212, shown in FIG. 11, corresponds to the desired spacing between pixels 12, 512, pixel groups, emitter tips 56, 556 or emitter tip groups. The distance 211 can be about 0.5 to about 10 millimeters, and is preferably about 4 millimeters. The number of slots 212 corresponds to the number of fibers 136, 138, respectively, which corresponds to the line and space pitch of the selected flat panel display design and type.

Referring to FIG. 12, the mandrel 200 has a length 214 which is generally greater than the length 124 of the assembly 118, 618. The length 214 of the mandrel can be any size which corresponds generally to the length of the image display panel 10, 510. The width 216 of the mandrel is generally greater than the width 126 of the assembly 118, 618 to provide an edge for trimming. The width 216 of the mandrel 200 can be any size which corresponds generally to the width of the image display panel 10, 510. The thickness 218 of the mandrel 200 is generally equal to the thickness 128 of the assembly 118, 618 and corresponds to the desired spacing between the emitter 16, 516 and the display 20, 520.

Figure 13:
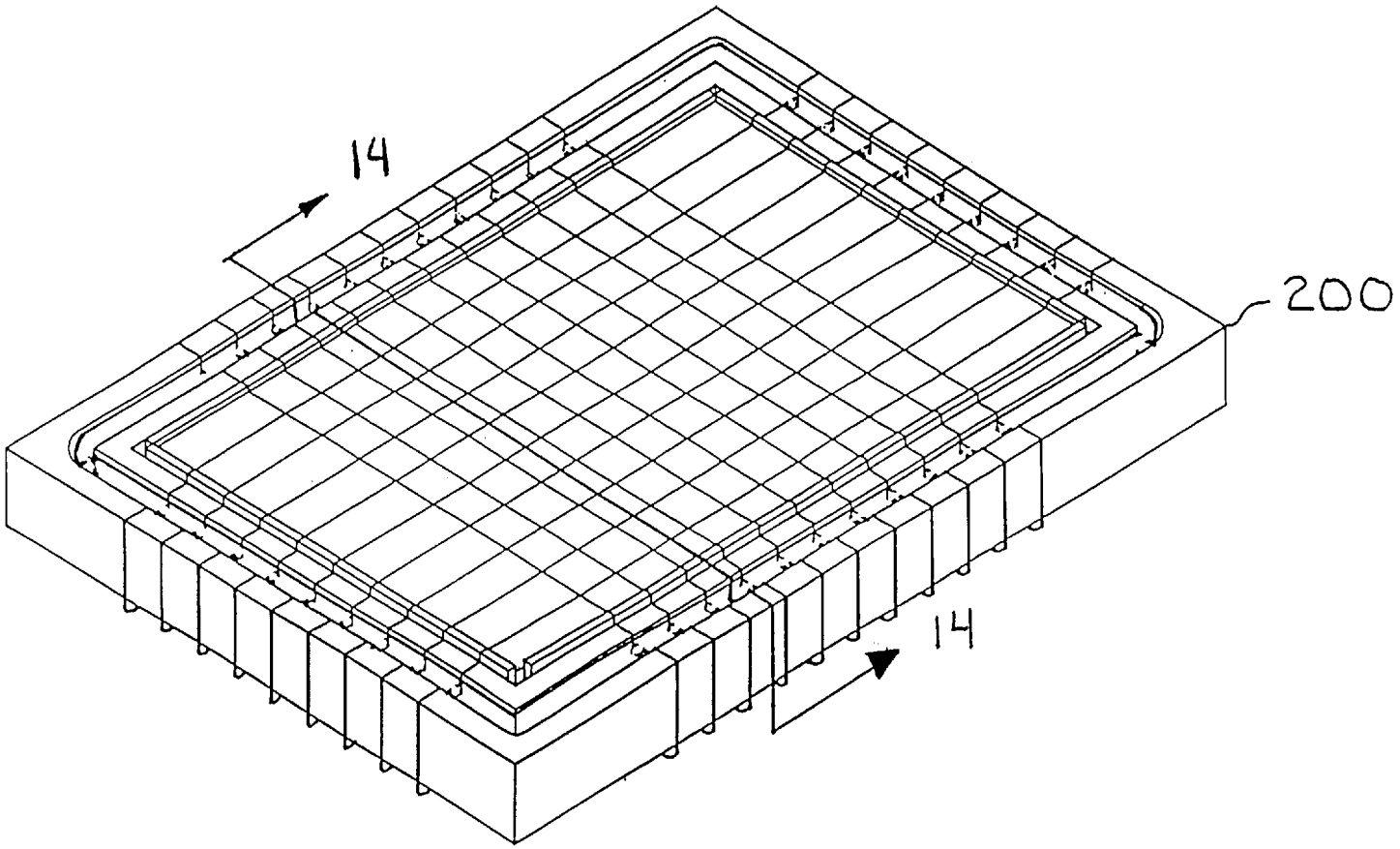
FIG. 13 is an enlarged perspective view of the mandrel of FIG. 12 having a plurality of fibers wound thereon and a sealing frame according to the present invention.

As shown in FIG. 11, the mandrel 200 includes a groove 220 having a bottom 222 and opposed, generally parallel walls 224 extending therefrom. The groove 220 receives the fibers 136,138 and the support 182, 682 (as shown in FIGS. 13 and 14). The depth 226 of the groove 220 corresponds generally to the desired height 180 of the sealing frame 158, 658 and can be about one-third to about two-thirds of the height 218 of the mandrel 200. The width 228 of the groove 220 can be about 0.2 to about 1.5 millimeters.

Referring now to FIG. 14, the mandrel 200 preferably has a recess 230 in the top 204 for receiving and retaining a removable insert 232. The insert 232 can be removed from the recess 230 to facilitate removal of the wound spacer 116, 616 or spacer unit 114, 614 therefrom. The recess 230 preferably includes one or more apertures 236 (shown in phantom in FIG. 11) therethrough for facilitating removal of the insert 232. Preferably, the recess 230 is about 50 to about 75 percent of the height 218 of the mandrel 200.

The insert 232 is preferably generally rectangular or square and can be formed from graphite or any suitable rigid material such as the materials described above for the base 202. As shown in FIG. 11, the insert 232 has a length 238, a width 240 and a height 242 of about 80 to about 100 percent of the desired size of the display area. The insert 232 dimensions are selected to ensure that the fiber spacing to be placed in the active display area will be maintained at the desired pitch during spacer manufacturing. The insert 232 has a top portion 244 having a plurality of slots 246 for aligning the fibers 136, 138. The depth 248, diameter 250 and distance 252 between the slots 246 is preferably generally equal to the depth 213, diameter and distance 211 between the slots 212 in the base 202 of the mandrel 200.

The recess 230 can also receive removable precision alignment members 234 for aligning the fibers 136, 138 in the insert 232. The alignment members 234 can be formed from any rigid material such as are discussed above for the base 202, however preferred materials are those which can be machined to precise tolerances of about ±25 micrometers. Non-limiting examples of such materials include silicon and DELRIN®.

The alignment members 234 are preferably rod-shaped as shown in FIGS. 11–14 and are positioned between the recess 230 and the insert 232. The alignment members 234 have in a top portion 254 thereof a plurality of slots 258 for receiving and aligning the fibers 136, 138, as shown in FIG. 11. The depth and diameter of the slots 258 in the alignment members 234 are preferably less than the depth 248 and diameter 250 of the slots 246 in the insert 232. The depth of the slots 258 in the alignment members 234 is generally greater than the desired thickness 128 of the spacer 116. The diameter of the slots 258 in the alignment members 234 is generally slightly greater than the diameter of the fibers 136, 138. The distance 256 between the slots 258 is generally equal to the distance 211 between the slots 212 in the base 202 of the mandrel 200, and is preferably equal to the desired pitch for the spacer assembly 118, 618.

The mandrel 200 can be positioned in any suitable filament winding machine, such as those which are commercially available from McLean-Anderson of Milwaukee, Wis., and the fibers 136 and 138 wound about the mandrel in any pattern as desired. For example, the first and second layers 130, 140 can be wound in alternating fashion or in any order desired.

Alternatively, the fibers 136 and 138 can be interwoven using looms such as are commercially available from Tsudakoma of Kanazawa, Japan and Sulzer-Ruti of Zurich, Switzerland.

A spacer unit 114 according to the present invention can be formed by the following method. As shown in FIG. 11, the insert 232 and alignment members 234 are positioned within the recess 230 of the base 202 of the mandrel 200. Fibers 136 are wound about the mandrel 200 through the slots 212, 246 and 258 to form a first layer 130. Next, fibers 138 are wound generally perpendicularly to the fibers 136 about the mandrel 200 through the slots 212, 246 and 258 to form a second layer 140. Alternating first layers 130 and second layers 140 are wound about the mandrel 200 to form the assembly 118 of the spacer 116 to the desired height which corresponds to the distance desired to be maintained between the emitter 16 and the display 20.

The fibers 136 and/or 138 can be coated with the bonding composition prior to winding or the wound assembly 118 can be coated by spraying or immersing the assembly in the bonding composition, as discussed above.

The assembly 118 and mandrel 200 can be heated at a temperature and for a time sufficient to cure the curable components of the bonding composition. For example, for an aqueous suspension of the bonding composition having about 80 weight percent solids containing bis (trimethoxysilylpropyl) amine applied to glass fibers, the assembly 118 and mandrel 200 can be heated at a temperature of about 500° C. for about one (1) hour to substantially cure the bonding composition and bond the fibers 136, 138 together in a substantially rigid assembly 118. The assembly 118 and mandrel 200 are cooled to ambient temperature (about 25° C.). The assembly 118 can be removed from the mandrel 200 by severing the fibers 136, 138 along the sides 208 or bottom 206 of the mandrel 200 and applying pressure to the bottom of the insert 232 through the apertures 236 in the mandrel 200 to unseat and remove the insert 232 and alignment members 234 from the recess 230.

Alternatively, to form a spacer unit 114 according to the present invention, prior to removing the spacer 116 from the mandrel 200, the support material can be positioned within the groove 220 of the mandrel 200. A release agent, such as graphite, can be used to coat the groove 220 prior to positioning the support material therein.

The support material can be cured prior to or during heating of the spacer unit 114 to mold and harden the support 182, 682 about the fibers 136, 138 in the groove 220. Heat or a curing agent can be applied to the support material, and preferably also to the mandrel 200 and assembly 118, to deform the support material and cause the support material to substantially encapsulate the fibers 136, 138 in the groove 220.

The spacer unit 114, 614 can be heated under pressure, for example by using a heated lamination press as discussed above. One skilled in the art would understand that the temperature and time for deforming or curing the support material can vary based upon such factors as the material selected for use and the amount of material used.

For example, if the support material is SCA-5 glass which is commercially available from SEM-COM Co. Inc. of Toledo, Ohio, the support material can be deformed by heating to a temperature of about 730° C. for about 30 minutes. After cooling and solidification of the support, sealing material such as SCB-2 glass can be coated upon the portions of the support to be positioned near the emitter and display and the sealing unit can be positioned between the emitter and display and heated to a temperature sufficient to deform the sealing material and bond the sealing unit to the emitter and display.

The sealing material 172, 672 can be applied to the support 182, 682 in the groove 220 if space permits, or the spacer 116 and hardened support 182, 682 can be removed from the mandrel 200 before the sealing material 172, 672 is applied prior to positioning the spacer unit 114, 614 within the image display panel 10, 510.

After heating, the spacer unit 114 can be cooled to ambient temperature (about 25° C.) to permit resolidification of the support 182, 682 about the fibers 136, 138, to form a generally rigid spacer unit 114. The spacer unit 114 can be removed from the mandrel 200 as discussed above.

One skilled in the art would understand that the spacer unit 616 can be formed in a similar manner to that described above with respect to the spacer unit 116 by omitting the second layer(s) 140 of fibers 138.

The present invention also includes a method for aligning an emitter substrate with a display. Preferably, the methods are carried out in an inert gas vacuum, i.e., at a pressure less than about 760 torr using an inert gas such as is discussed above.

The method includes positioning the spacer unit 114, 614 between an emitter 16, 516 and a display 20, 520 to align selected emitter elements with corresponding display elements to permit energy or other particles to flow from the emitter 16, 516 through the corresponding passageways 148, 648 of the spacer 116, 616 to the corresponding portion of the display 20, 520. For example, in a field emission display, the spacer unit is positioned to align the emitter tips 56, 556 with the corresponding passageways 148, 648 and corresponding portions of the display 20, 520.

The spacer unit 114, 614 can be bonded first to either the emitter 16, 516 or display 20, 520, or it can be essentially simultaneously bonded to both to form the image display panel 10, 510.

The spacer unit 114, 614, and preferably the entire image display panel 10, 510, is heated to deform or otherwise cure the sealing material 172, 672 to bond the sealing frame 158, 658 between the emitter 16, 516 and display 20, 520 to align the emitter 16, 516 and display 20, 520.

If a heat-hardenable sealing material 172, 672 is used, the spacer unit 114, 614 is heated to a predetermined temperature sufficient to deform the sealing material 172, 672, causing it to bond to the emitter 16, 516 and display 20, 520, but less than the predetermined temperature at which the other components of the image display panel 10, 510 deform, for example the emitter 16, 516, the display 20, 520 and the spacer 116, 616. For example, for SCB-2 glass sealing material, the spacer unit can be heated to a temperature of about 400° C. to about 550° C. for about 0.2 to about 0.5 hours to deform the sealing material yet not deform the emitter 16, 516, the display 20, 520 and the spacer 116, 616, which are composed of materials having higher deformation temperatures. The image display panel 10, 510 is then cooled to ambient temperature (about 25° C.).

The image display panel 10, 510 can be installed in a display device, such as a computer (not shown) or television (not shown). The image display panel 10, 510 can be connected to the energy source 66 prior or subsequent to installation.

An image display panel can be made using the above method either by assembling the above components of the image display panel in an inert gas vacuum as discussed above or by assembling the components at atmospheric pressure (about 760 torr) and evacuating the evacuatable or interior region formed between the emitter 16, 516 and display 20, 520 and bounded by the spacer unit 114, 614 to a predetermined vacuum pressure, examples of which are given above.

The present invention provides a spacer unit, image display panel and methods for making and using the same which provide dimensionally stable particle passageways between an emitter and a display, are resistant to thermal cycling, preferably free of bonding materials which can contaminate interior components, inexpensive to manufacture and install in an image display panel, easily modified to include additional components such as electrodes, and are essentially self-leveling and self-aligning when installed between an emitter panel and a display panel.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, I claim:

1. A spacer unit, comprising:

(a) a spacer for separating and aligning an emitter and a display of an image display panel, the spacer comprising an assembly having a first side, a second side and a third side extending between the first side and the second side, the assembly comprising at least one layer having a first side and a second side, the layer comprising a plurality of generally parallel, spaced apart fibers, the assembly having a plurality of passageways between the fibers of the layer, the passageways being generally perpendicular to the fibers of the layer, such that when the assembly is positioned between an emitter and a display of an image display panel at least one of the passageways permits the passage of energy therethrough between the emitter and the display; and (b) a sealing frame positioned about and engaging at least a portion of the third side of the spacer, the sealing frame having a first end adapted to be positioned adjacent to a portion of the emitter of the image display panel and a second end adapted to be positioned adjacent to a portion of the display of the image display panel, the sealing frame comprising:

(1) a support positioned about and engaging at least a portion of the third side of the spacer and maintaining the fibers of the layer in generally parallel alignment, the support having a first end, a second end and a side therebetween; and (2) a sealing material positioned upon at least a portion of the first end or the second end of the support for bonding said portion of the support to a portion of an emitter and a portion of a display of an image display panel, such that when the sealing frame and spacer are positioned between the emitter and the display of the image display panel, the sealing frame provides an essentially sealed region therebetween.

2. The spacer unit according to claim 1, wherein the emitter is a cathode.

3. The spacer unit according to claim 1, wherein the emitter comprises a plurality of emitter tips, each emitter tip being positioned at an end of a passageway and spaced apart from the display.

4. The spacer unit according to claim 1, wherein the display is an anode.

5. The spacer unit according to claim 1, wherein the image display panel is a field emission display.

6. The spacer unit according to claim 1, wherein at least one of the fibers of the layer of the spacer is formed from a material selected from the group consisting of natural organic polymers, synthetic organic polymers, inorganic materials and combinations thereof.

7. The spacer unit according to claim 6, wherein at least one of the fibers of the layer of the spacer is formed from an inorganic material which is glass.

8. The spacer unit according to claim 1, wherein the spacer comprises a plurality of generally parallel assemblies.

9. The spacer unit according to claim 1, wherein the assembly comprises a plurality of layers.

10. The spacer unit according to claim 1, wherein the support is formed from a material which is different from the sealing material.

11. The spacer unit according to claim 1, wherein the support is formed from a hardenable material having a predetermined deformation temperature which is less than a predetermined deformation temperature of a component of the image display panel selected from the group consisting of the emitter, the display and the spacer.

12. The spacer unit according to claim 11, wherein the hardenable material from which the support is formed is a glass material.

13. The spacer unit according to claim 1, wherein the sealing material is formed from a material having a predetermined deformation temperature which is less than a predetermined deformation temperature of a component of the image display panel selected from the group consisting of the emitter, the display, the spacer and the support, such that when (i) the support and the spacer are positioned between the emitter and the display and (ii) the sealing material is heated to a temperature greater than the predetermined deformation temperature of the sealing material but less than the predetermined deformation temperature of a component of the image display panel selected from the group consisting of the emitter, the display, the spacer and the support, the sealing material provides an essentially sealed region between the spacer, the emitter and the display.

14. The spacer unit according to claim 1, wherein the sealing material is an adhesive material.

15. The spacer unit according to claim 1, wherein the sealing material is a glass material.

16. The spacer unit according to claim 1, wherein the assembly of the spacer further comprises at least one second layer having a first side and a second side and comprising a plurality of generally parallel, spaced apart fibers, the second side of the first layer being adjacent to the first side of the second layer, the fibers of the first layer being positioned to form a plurality of intersections with the corresponding fibers of the second layer, the plurality of passageways of the assembly being located between the fibers of the first layer, the fibers of the second layer and the corresponding intersections.

17. The spacer unit according to claim 16, further comprising a bonding composition applied to the intersections of the fibers of the first layer and the fibers of the second layer.

18. The spacer unit according to claim 17, wherein the bonding composition is selected from the group consisting of cementitious materials, coupling agents, gels and combinations thereof.

19. The spacer unit according to claim 18, wherein the bonding composition is a coupling agent selected from the group consisting of organo silane coupling agents, transition metal coupling agents, phosphonate coupling agents, amino-containing Werner coupling agents and mixtures thereof.

20. The spacer unit according to claim 16, wherein the spacer further comprises a fiber protectorant for protecting the fibers of the first layer and the corresponding fibers of the second layer from abrasion at the intersections thereof.

21. The spacer unit according to claim 20, wherein the fiber protectorant, upon heating of the fiber protectorant to a predetermined bonding temperature, bonds the fibers of the first layer and the corresponding fibers of the second layer at the intersections thereof.

22. The spacer unit according to claim 21, wherein the fiber protectorant is a coupling agent.

23. The spacer unit according to claim 16, wherein the assembly comprises a plurality of second layers.

24. The spacer unit according to claim 1, wherein the assembly further comprises at least one electrode.

25. An image display panel comprising:

(a) an emitter;

(b) a display; and (c) the spacer unit of claim 1 positioned therebetween.

* * * * *